US011339022B2

(12) United States Patent
Yamaji et al.

(10) Patent No.: US 11,339,022 B2
(45) Date of Patent: May 24, 2022

(54) SHEET STACKER AND IMAGE FORMING APPARATUS INCORPORATING THE SHEET STACKER

(71) Applicants: Kensuke Yamaji, Kanagawa (JP); Yosuke Eguchi, Tokyo (JP)

(72) Inventors: Kensuke Yamaji, Kanagawa (JP); Yosuke Eguchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 121 days.

(21) Appl. No.: 16/859,903

(22) Filed: Apr. 27, 2020

(65) Prior Publication Data

US 2020/0361739 A1 Nov. 19, 2020

(30) Foreign Application Priority Data

May 14, 2019 (JP) ..... JP2019-091288

(51) Int. Cl.
*B65H 31/10* (2006.01)

(52) U.S. Cl.
CPC ..... *B65H 31/10* (2013.01)

(58) Field of Classification Search
CPC ..... B65H 31/00; B65H 31/04; B65H 31/08; B65H 31/10; B65H 31/12; B65H 31/14; B65H 2405/00; B65H 2405/1116; B65H 2405/11162; B65H 2405/1117
See application file for complete search history.

(56) References Cited

U.S. PATENT DOCUMENTS 5,497,984 A 3/1996 Murakami et al.
2002/0195768 A1* 12/2002 Yamakawa ..... B65H 39/11 271/215
2005/0286947 A1* 12/2005 Kitamura ..... G03G 15/6511 399/393
2012/0061903 A1 3/2012 Eguchi et al.
2013/0250328 A1 9/2013 Ohtsuka et al.
2013/0270765 A1 10/2013 Araaki et al.
2016/0332829 A1 11/2016 Eguchi
(Continued)

FOREIGN PATENT DOCUMENTS

JP S6341350 A 2/1988
JP 4-243766 8/1992
(Continued)

OTHER PUBLICATIONS

European Search Report; Application EP20169898; dated Oct. 27, 2020.

*Primary Examiner* — Prasad V Gokhale
(74) *Attorney, Agent, or Firm* — Duft & Bornsen, PC

(57) ABSTRACT

A sheet stacker includes a sheet stacking member, a biasing force applier, an angle changer, and a biasing force change reducer. The sheet stacking member has an upstream portion in a sheet conveyance direction. The upstream portion is movable in a vertical direction. The biasing force applier is configured to bias the sheet stacking member upward. The angle changer is configured to change an angle of a sheet stacking face of the sheet stacking member, relative to a surface of a sheet conveyed through a sheet conveying portion. The biasing force change reducer is configured to restrain a change of a biasing force acting on the sheet stacking member, before and after a change of the angle of the sheet stacking member by the angle changer.

13 Claims, 16 Drawing Sheets

(56) References Cited

U.S. PATENT DOCUMENTS

| | | | | |
|---|---|---|---|---|
| 2017/0255153 | A1 | 9/2017 | Eguchi | |
| 2018/0127222 | A1 | 5/2018 | Kuno et al. | |
| 2018/0237252 | A1* | 8/2018 | Seo | B42C 1/12 |
| 2018/0265321 | A1 | 9/2018 | Sato | |
| 2020/0270089 | A1* | 8/2020 | Yamaji | B65H 31/26 |

FOREIGN PATENT DOCUMENTS

| | | |
|---|---|---|
| JP | 2002-226119 | 8/2002 |
| JP | 2010-265048 | 11/2010 |
| JP | 2013-173590 | 9/2013 |
| JP | 2014-169161 | 9/2014 |

* cited by examiner

SHEET STACKER AND IMAGE FORMING APPARATUS INCORPORATING THE SHEET STACKER

CROSS-REFERENCE TO RELATED APPLICATION

This patent application is based on and claims priority pursuant to 35 U.S.C. § 119(a) to Japanese Patent Application No. 2019-091288, filed on May 14, 2019, in the Japan Patent Office, the entire disclosure of which is hereby incorporated by reference herein.

BACKGROUND

Technical Field

This disclosure relates to a sheet stacker and an image forming apparatus incorporating the sheet stacker.

Background Art

Various types of sheet stackers are provided in an electrophotographic image forming apparatus to stack a sheet or sheets on a sheet stacking face of a sheet stacking member.

SUMMARY

At least one aspect of this disclosure provides a novel sheet stacker includes a sheet stacking member, a biasing force applier, an angle changer, and a biasing force change reducer. The sheet stacking member has an upstream portion in a sheet conveyance direction. The upstream portion of the sheet stacking member is movable in a vertical direction. The biasing force applier is configured to bias the sheet stacking member upward. The angle changer is configured to change an angle of a sheet stacking face of the sheet stacking member, relative to a surface of a sheet conveyed through a sheet conveying portion. The biasing force change reducer is configured to restrain a change of a biasing force acting on the sheet stacking member, before and after a change of the angle of the sheet stacking face of the sheet stacking member by the angle changer.

Further, at least one aspect of this disclosure provides an improved image forming apparatus includes an image bearer configured to form an image on a sheet, and the above-described sheet stacker configured to stack the sheet having the image.

BRIEF DESCRIPTION OF THE SEVERAL VIEWS OF THE DRAWINGS

Exemplary embodiments of this disclosure will be described in detail based on the following figures, wherein.

Figure 1:
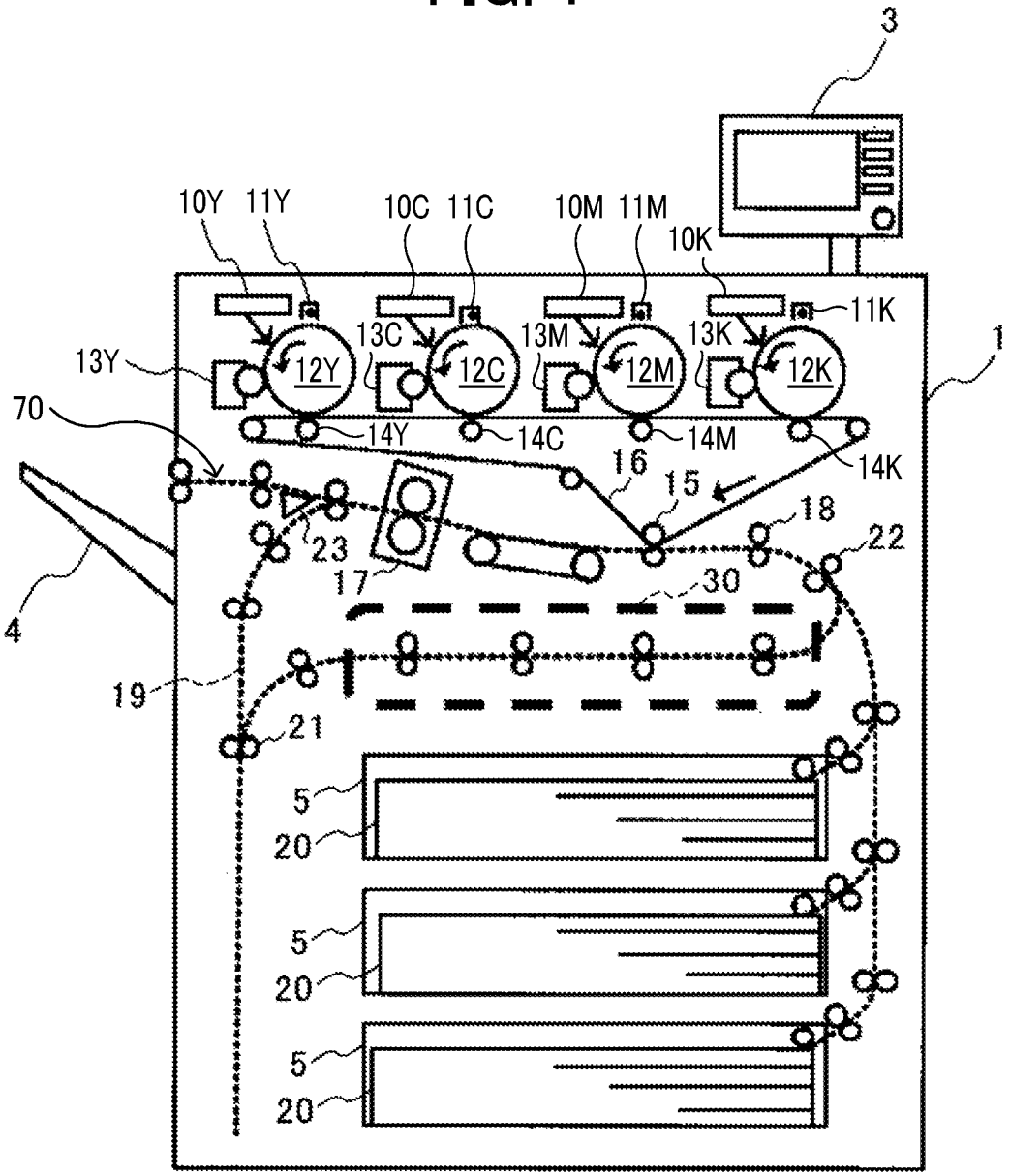
FIG. 1 is a schematic view illustrating an example of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a detailed description is given of an embodiment of this disclosure with reference to the drawings.

FIG. 1 is a schematic view illustrating an example of an image forming apparatus 1 according to an embodiment of this disclosure.

As illustrated in FIG. 1, the image forming apparatus 1 (a printer in this disclosure) includes an intermediate transfer belt 16. The intermediate transfer belt 16 moves while being stretched over a plurality of rollers. On the upper side in FIG. 1, photoconductors 12Y, 12C, 12M, and 12K are provided for forming yellow (Y), cyan (C), magenta (M), and black (K) images, respectively. Hereinafter, the photoconductors 12Y, 12C, 12M, and 12K are occasionally referred to as a photoconductor 12 in a singular form, for convenience. The photoconductors 12 that functions as an image bearer is surrounded by a laser scanning unit (that is, laser scanning units 10Y, 10C, 10M, and 10K), a charging unit 11 (that is, charging units 11Y, 11C, 11M, and 11K), a developing unit 13 (that is, developing units 13Y, 13C, 13M, and 13K), and a primary transfer roller 14 (that is, primary transfer rollers 14Y, 14C, 14M, and 14K). The primary transfer roller 14 is disposed facing the photoconductor 12 while sandwiching the intermediate transfer belt 16 with the photoconductor 12.

A secondary transfer roller 15 is provided in a secondary transfer portion and below the intermediate transfer belt 16. After being transferred onto the intermediate transfer belt 16 by primary transfer, a toner image is then transferred onto a sheet 20 by secondary transfer. A fixing device 17 is provided downstream from the secondary transfer portion having the secondary transfer roller 15, in a sheet conveyance direction in which the sheet 20 is conveyed. A sheet position correcting device 30 is provided substantially at the center of the housing of the image forming apparatus 1, below the secondary transfer portion and the fixing device 17, and in the middle of a sheet reversal conveyance passage 19 along which the sheet 20 is conveyed.

A control panel 3 is disposed on top of the housing of the image forming apparatus 1. A sheet ejection device 4 that functions as a sheet stacker is disposed on the left-side face of the housing of the image forming apparatus 1 in FIG. 1. Further, three sheet feed trays 5 (specifically, first, second, and third sheet feed trays 5) are disposed in a lower part of the housing of the image forming apparatus 1, below the sheet position correcting device 30. Each of the sheet feed trays 5 contains the sheet 20 or a sheet bundle including the sheet 20. Hereinafter, the sheet 20 is occasionally referred to as the "sheets 20" in a plural form. Specifically, each of the first, second, and third sheet feed trays 5 stores the sheet 20 such as a transfer sheet and a resin film. Any one of the first, second, and third sheet feed trays 5 is selected according to the sheet 20 to use for image formation, via the control panel 3 or an input terminal such as a personal computer. The image forming apparatus 1 further includes a control device that functions as a controller including various units, for example, a central processing unit (CPU), a random access memory (RAM), and a read only memory (ROM), to control the image forming apparatus 1.

As a print job starts in the image forming apparatus 1, the photoconductor 12 (that is, the photoconductors 12Y, 12C, 12M, and 12K) is rotated in a counterclockwise direction in FIG. 1. At this time, the charging unit 11 (that is, the charging units 11Y, 11C, 11M, and 11K) uniformly charges the surface of the photoconductor 12 to a given charging polarity. Then, the laser scanning unit 10 (i.e., the laser scanning units 10Y, 10C, 10M, and 10K) emits laser light based on image data, onto the charged surface of the photoconductor 12, thereby forming an electrostatic latent image on the surface of the photoconductor 12. Then, the developing unit 13 develops the electrostatic latent image formed on the surface of the photoconductor 12 into a visible toner image. The toner image is transferred onto the surface of the intermediate transfer belt 16 by the primary transfer roller 14. Note that residual toner remains on the surface of the photoconductor 12 after the primary transfer of the toner image onto the intermediate transfer belt 16. Such residual toner is removed by a photoconductor cleaning unit provided in the housing of the image forming apparatus 1.

When forming a color image, the above-described image forming operation is performed in the photoconductors 12Y, 12C, 12M, and 12K, so that a yellow toner image, a cyan toner image, a magenta toner image, and a black toner image formed on respective photoconductors 12Y, 12C, 12M, and 12K are sequentially transferred onto the intermediate transfer belt 16 in a superimposed manner.

On the other hand, as described above, any one of the first, second, and third sheet feed trays 5 disposed in the lower part of the housing of the image forming apparatus 1 is selected according to the sheet 20 to use for image formation. After the sheet feed tray 5 is selected via the control panel 3 or the input terminal such as a personal computer, the sheet 20 is fed from the selected sheet feed tray 5. The sheet 20 fed from the selected sheet feed tray 5 is conveyed toward a pair of registration rollers 18. The sheet 20 contacts the pair of registration rollers 18 while the pair of registration rollers 18 is stopped (is not rotating). Thus, after the leading end of the sheet 20 is aligned, the pair of registration rollers 18 conveys the sheet 20 toward the secondary transfer portion, in which the secondary transfer roller 15 and the sheet 20 meets the toner image, on the intermediate transfer belt 16.

Then, the toner image formed on the surface of the intermediate transfer belt 16 is transferred onto the sheet 20 by the secondary transfer roller 15. After the toner image has been transferred onto the sheet 20, the sheet 20 is conveyed to the fixing device 17, where the unfixed toner image is fixed, and then is ejected to the sheet ejection device 4 via a sheet conveyance passage 70. Note that residual toner remains on the surface of the intermediate transfer belt 16 after the secondary transfer of the toner image onto the sheet 20. Such residual toner is removed by an intermediate transfer belt cleaning unit provided in the housing of the image forming apparatus 1.

In a case in which duplex printing on the sheet 20 is selected via the control panel 3 or the input terminal such as a personal computer, a switching claw 23 switches and changes an orientation (sheet conveyance passage) of the sheet 20, so that the sheet 20 having an image on a first face is conveyed to a duplex printing passage. Then, the sheet 20 is conveyed to a sheet reversing roller 21. When the sheet 20 sent to the sheet reversing roller 21 by the switching claw 23, the sheet reversing roller 21 starts rotating in the opposite direction (reverse direction) to a regular rotational direction (forward rotation), thereby conveying the sheet 20 to the sheet position correcting device 30. At this time, the front and back faces of the sheet 20 in the sheet conveyance direction are reversed from first face image formation. After the sheet 20 is conveyed from a relay roller 22 to the pair of registration rollers 18, a second image is formed on a second face of the sheet 20 by the same process as the above-described image formation, and then the sheet 20 is ejected to the sheet ejection device 4.

Next, a description is given of the configuration and operations of the sheet ejection device 4 that functions as a sheet stacker.

Figure 2:
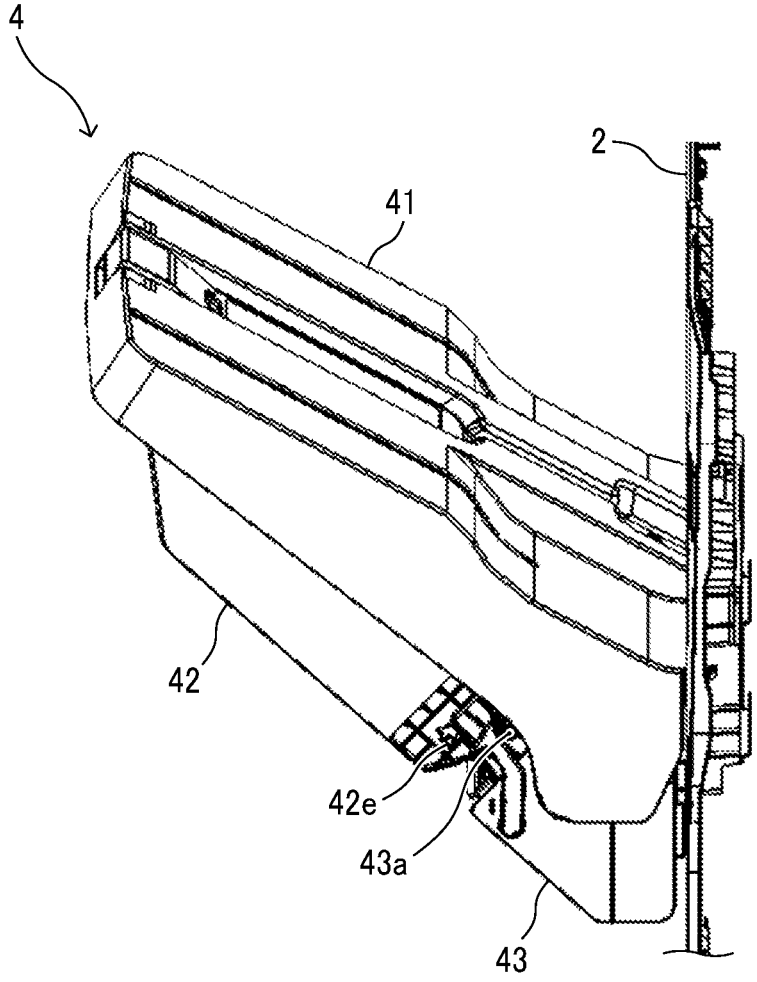
FIG. 2 is a perspective view illustrating a sheet ejection tray according to an embodiment of this disclosure, viewed from obliquely above.

FIG. 2 is a perspective view illustrating the sheet ejection device 4 according to the present embodiment of this disclosure, viewed from obliquely above.

Figure 3:
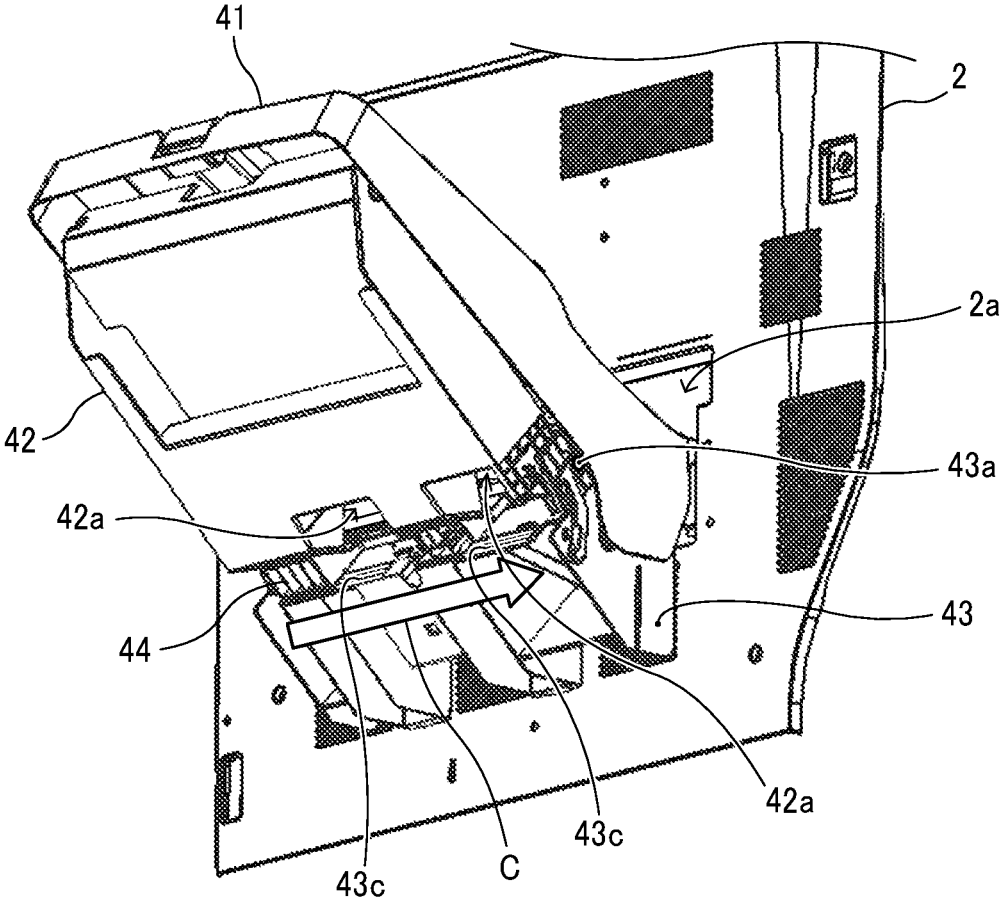
FIG. 3 is a perspective view illustrating the sheet ejection tray according to an embodiment of this disclosure, viewed from obliquely below.

FIG. 3 is a perspective view illustrating the sheet ejection device 4 according to the present embodiment of this disclosure, viewed from obliquely below.

Figure 4:
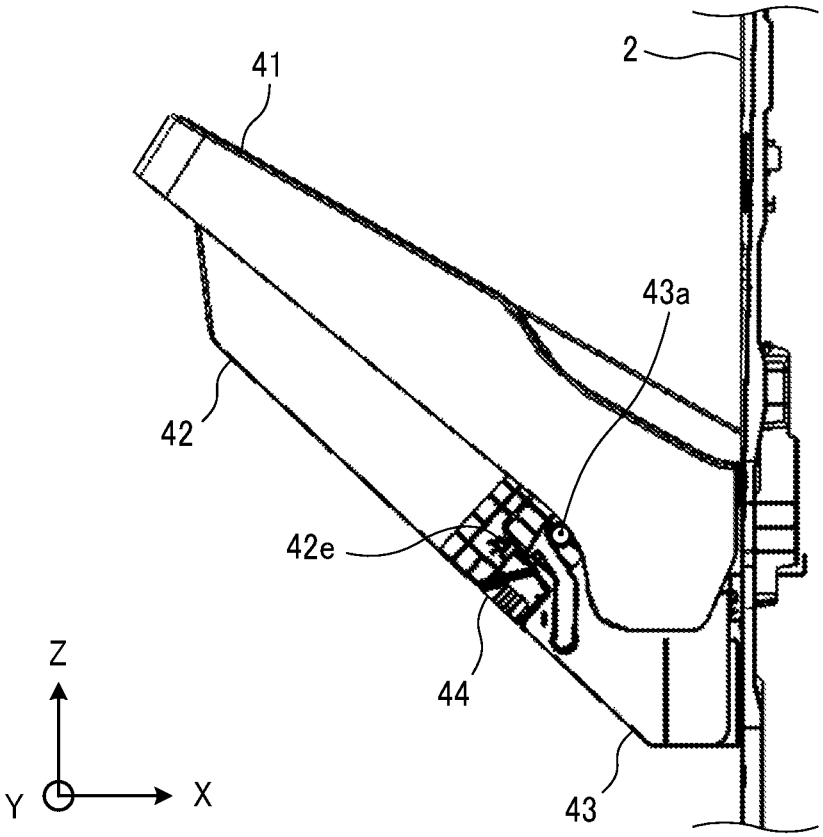
FIG. 4 is a side view illustrating the sheet ejection tray.

FIG. 4 is a side view illustrating the sheet ejection device 4 according to the present embodiment of this disclosure.

Figure 5:
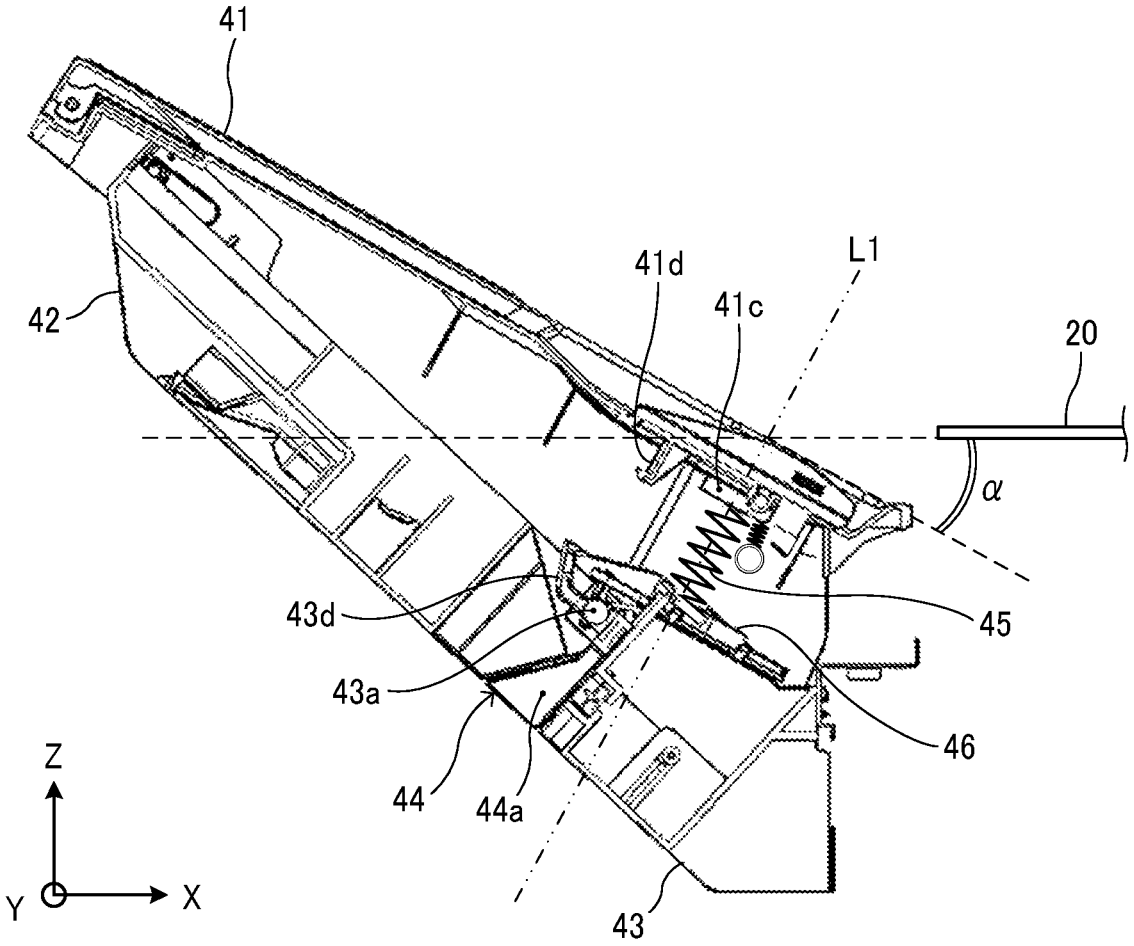
FIG. 5 is a cross-sectional view illustrating the sheet ejection tray having a first angle α as a tray angle, when the sheet ejection tray is cross-sectioned along a sheet conveyance direction.

FIG. 5 is a cross-sectional view illustrating the sheet ejection device 4 according to the present embodiment of this disclosure, when the sheet ejection device 4 is cross-sectioned along the sheet conveyance direction.

Figure 6:
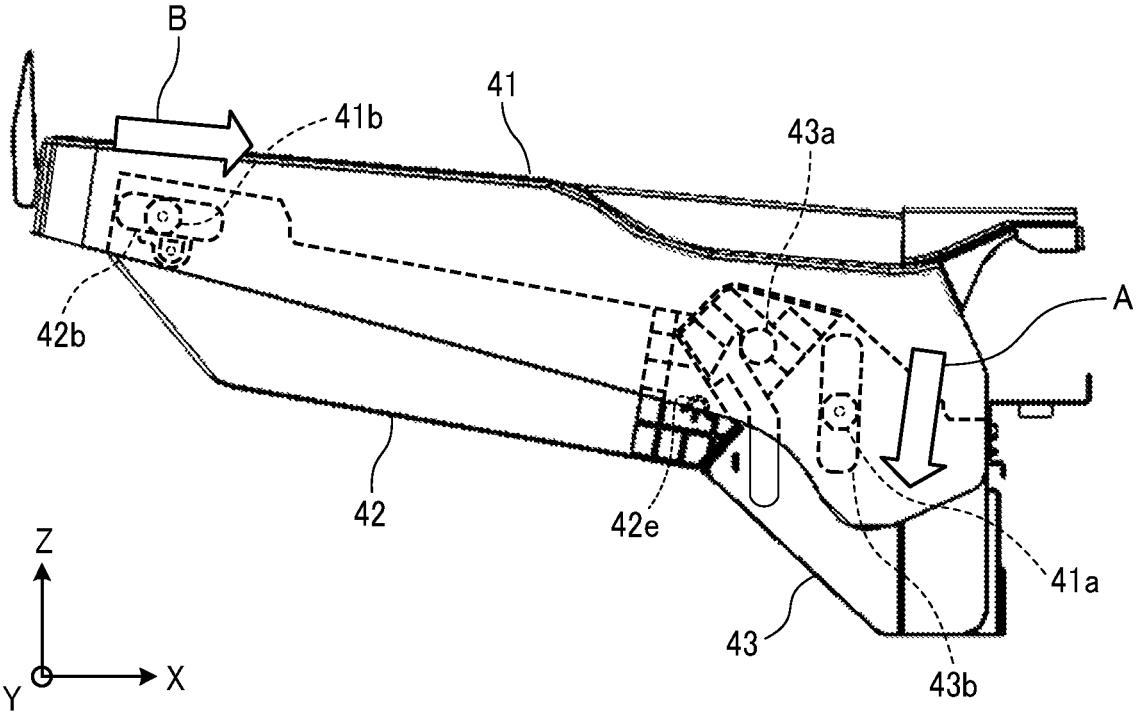
FIG. 6 is a side view illustrating an internal structure of the sheet ejection tray indicating by a broken line.

FIG. 6 is a side view illustrating the sheet ejection device 4 according to the present embodiment of this disclosure, indicating an internal structure of the sheet ejection device 4 by a broken line.

The sheet ejection device 4 according to the present embodiment includes an upper tray unit 41, a lower tray unit 42, a tray securing unit 43, and a slider 44.

The upper tray unit 41 functions as a sheet stacking member having an upper face as a sheet stacking face. The sheets 20 are ejected one by one through a sheet ejection port 2*a* that functions as a sheet conveying portion formed in a housing side face 2 of the housing of the image forming apparatus 1. The sheets 20 are sequentially ejected and stacked onto the upper face of the upper tray unit 41. The upper tray unit 41 has an upstream portion in a sheet conveyance direction (that is, a right-side in FIG. 4). The upstream portion in the sheet conveyance direction of the upper tray unit 41 is supported by the lower tray unit 42 to be movable in a vertical direction. Hereinafter, the upstream portion in the sheet conveyance direction of the upper tray unit 41 is simply referred to as the "upstream portion."

The tray securing unit 43 that functions as a securing member and a retainer includes a rotary shaft 43*a* extending in a direction perpendicular to the drawing sheet of FIG. 4 (that is, a Y direction indicated by arrow Y), in other words, a rotary shaft 43*a* extending in a horizontal direction perpendicular to the sheet conveyance direction. The lower tray unit 42 is rotatable about the rotary shaft 43*a* of the tray securing unit 43. At the same time, the lower tray unit 42 functions as a rotary support to support the upper tray unit 41 in the vertical direction and is included in an angle changer. That is, as the lower tray unit 42 rotates about the rotary shaft 43*a* of the tray securing unit 43, the upper tray unit 41 that is supported by the lower tray unit 42 also rotates about the rotary shaft 43*a* of the tray securing unit 43. Accordingly, an angle of the top face (the sheet stacking face) of the upper tray unit 41, relative to the face of the sheet 20 that is to be ejected (conveyed) from the sheet ejection port 2*a* (that is, an angle about the rotary shaft 43*a* of the tray securing unit 43), is changed. Hereinafter, the angle is referred to as a "tray angle."

The tray securing unit 43 is a securing member to be secured to the housing side face 2 of the image forming apparatus 1 and supports each end of the rotary shaft 43*a*. The tray securing unit 43 supports the lower tray unit 42 attached to the rotary shaft 43*a*, to rotate about the rotary shaft 43*a*. As illustrated in FIG. 5, a height adjuster spring 45 is disposed between the tray securing unit 43 and the upper tray unit 41. The height adjuster spring 45 is a compression spring that functions as a biasing member. By applying a biasing force of the height adjuster spring 45, the upper tray unit 41 is biased upwardly, relative to the tray securing unit 43. Note that two height adjuster springs 45 are provided in a direction of the front to back side of the image forming apparatus 1 (that is, the Y direction). However, any number of height adjuster springs 45 are determined.

As illustrated in FIG. 6, the upper tray unit 41 includes an upstream side guide projection 41*a* that is formed in an inner side face of the upstream portion of the upper tray unit 41 (that is, an inner wall face in the Y direction) and the tray securing unit 43 includes a vertical guide groove 43*b* that is formed in a side face of the tray securing unit 43 (that is, an outer wall face in the Y direction). The upper tray unit 41 is attached by fitting the upstream side guide projection 41*a* to the vertical guide groove 43*b*. The vertical guide groove 43*b* extends substantially in the vertical direction (that is, a Z direction indicated by arrow Z), as illustrated in FIG. 6. Therefore, the tray securing unit 43 supports the upper tray unit 41 so that the upper tray unit 41 is movable in the vertical direction (that is, the Z direction) while regulating movement of the upper tray unit 41 in an X direction indicated by arrow X (that is, a left-to-right direction or horizontal direction of the image forming apparatus 1).

The upper tray unit 41 further includes a downstream side guide projection 41*b* that is formed in the inner side face (that is, the inner wall face in the Y direction) of the downstream side portion in the sheet conveyance direction of the upper tray unit 41 (that is, simply referred to as a "downstream portion"). The downstream side guide projection 41*b* is attached to a horizontal guide groove 42*b* that is formed in the side face (that is, the outer wall face in the Y direction) of the lower tray unit 42. As illustrated in FIG. 6, the horizontal guide groove 42*b* extends substantially in the left-to-right direction of the image forming apparatus 1 (that is, the X direction). Therefore, while regulating movement of the upper tray unit 41 in the Z direction of the upper tray unit 41 (that is, the vertical direction), the lower tray unit 42 supports the upper tray unit 41 to be movable in the left-and-right direction (that is, the X direction).

The upstream portion of the upper tray unit 41 is biased upwardly by the height adjuster spring 45 disposed between the upper tray unit 41 and the tray securing unit 43. In a state in which no sheet 20 is held (stacked) on the upper tray unit 41, the upper tray unit 41 is maintained at the height (the initial height) at which the upstream side guide projection 41*a* is pressed against an upper end of the vertical guide groove 43*b* of the tray securing unit 43, by the biasing force of the height adjuster spring 45. Therefore, the upper limit position of the upstream portion of the upper tray unit 41 is regulated by an upper height limit position regulator that includes the upstream side guide projection 41*a* and the vertical guide groove 43*b*.

This initial height is set such that the height of the sheet stacking face of the upper tray unit 41 is at the substantially same height as (slightly lower than) the sheet 20 to be ejected (conveyed) through the sheet ejection port 2*a*. In a case in which the height of the sheet stacking face of the upstream portion of the upper tray unit 41 is too low with respect to the sheet 20 to be ejected through the sheet ejection port 2*a*, the leading end of the sheet 20 contacts the sheet stacking face of the upper tray unit 41 while being hanged down by the own weight of the sheet 20. Therefore, the trailing end of the sheet 20 is conveyed prior to the leading end of the sheet 20 in the sheet conveyance direction, and an inconvenience occurs to curl up the sheet 20 into a roll shape. Conversely, in a case in which the height of the sheet stacking face of the upstream portion of the upper tray unit 41 is too high with respect to the sheet 20 to be ejected through the sheet ejection port 2*a*, the leading end of the sheet 20 collides an end face of the upper tray unit 41 prior to the upstream portion of the upper tray unit 41. Therefore, an inconvenience in which the sheet 20 is not conveyed appropriately to the upper tray unit 41 occurs. The initial height of the upper tray unit 41 according to the present embodiment is set to restrain these inconveniences.

When the sheets 20 are sequentially ejected (conveyed) from the sheet ejection port 2*a*, to the upper tray unit 41 at the above-described initial height, due to the own weight of the sheets 20 stacked on the upper tray unit 41, the upper tray unit 41 is pushed down, against the biasing force of the height adjuster spring 45, in a direction indicated by arrow A in FIG. 6. With this action, the upper tray unit 41 is pressed down as the sheet stacking amount of the sheets 20 on the upper tray unit 41, so that the height of the sheet face of the uppermost sheet P on the upper tray unit 41 is constantly maintained to be substantially the same as (slightly lower than) the height of the sheet 20 to be ejected (conveyed) through the sheet ejection port 2*a*. Therefore, even after the sheets 20 are stacked, the above-described inconvenience is restrained.

In the present embodiment, the extending direction of the vertical guide groove 43*b* provided in the tray securing unit 43 is not completely level to the vertical direction (the direction Z) but is slightly inclined. Specifically, as illustrated in FIG. 6, the position of the lower end side of the vertical guide groove 43*b* in the horizontal direction (the position in the X direction) is farther from the sheet ejection port 2*a*, than the position of the upper end side of the vertical guide groove 43*b*. Thus, the upstream portion of the upper tray unit 41 moves downward while being displaced (shifted) in the X direction to move away from the sheet ejection port 2*a* as the sheet stacking amount of the sheets 20 on the upper tray unit 41 increases. According to this configuration, when the upstream portion of the upper tray unit 41 in the sheet conveyance direction moves downward, the upstream portion of the upper tray unit 41 is prevented from interfering the housing side face 2 of the image forming apparatus 1. Accordingly, the upper tray unit 41 moves stably in the vertical direction.

Note that, in order to move the upper tray unit 41 as described above, the upper tray unit 41 is displaced (shifted) in the X direction, relative to the lower tray unit 42 that supports the downstream side portion of the upper tray unit 41. In the present embodiment, as described above, since the downstream side guide projection 41*b* of the upper tray unit 41 is attached by fitting to the horizontal guide groove 42*b* extending in the X direction of the lower tray unit 42, the upper tray unit 41 is displaced (shifted) in the X direction, relative to the lower tray unit 42, as indicated by arrow B in FIG. 6, which achieves the above-described stable vertical movement.

In recent years, due to diversification of types of sheets, sheets may not be properly stacked on the sheet ejection device 4 depending on the type of sheets. For example, as illustrated in FIG. 5, in a case in which a sheet having a low stiffness and a large contact resistance, such as a coated thin paper, is conveyed to a sheet stacking face that is relatively largely inclined upwardly toward the downstream in the sheet conveyance direction, the leading end of the sheet in contact with the sheet stacking face does not slidably climb up due to the high contact resistance and the trailing end of the sheet is fed to bend in a bellows shape due to the low stiffness.

In order to address this inconvenience, to provide the appropriate sheet stackability to various types of sheets including this sheet, a slider 44 that functions as an angle changer to change the angle of the top face (sheet stacking face) of the upper tray unit 41 relative to the surface of the sheet 20 to be ejected (conveyed) from the sheet ejection port 2*a*.

Figure 7:
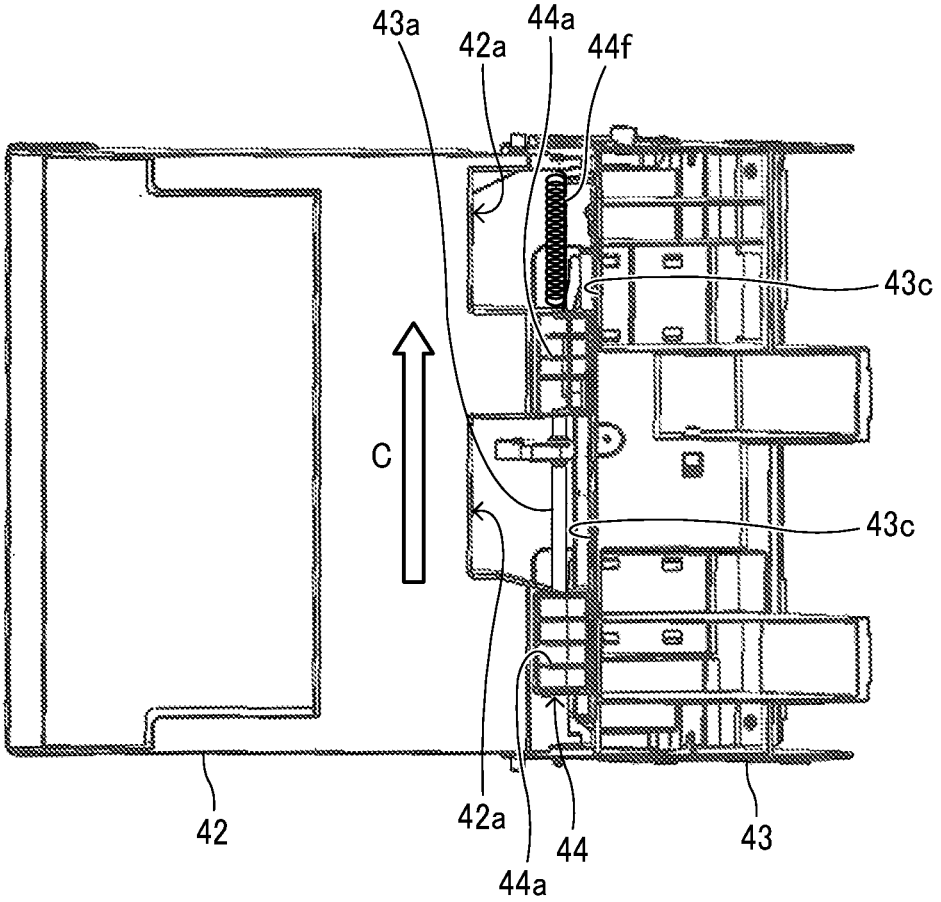
FIG. 7 is a bottom view illustrating the sheet ejection tray with an upper tray unit being removed.
Figure 8A:
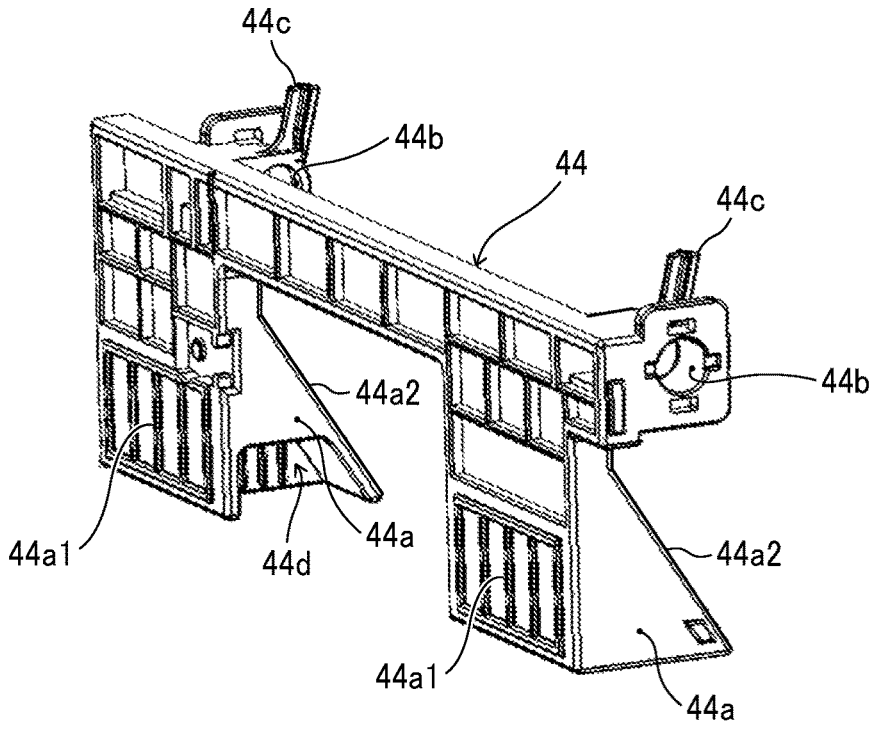
FIG. 8A is a perspective view illustrating a slider, viewed from a direction.
Figure 8B:
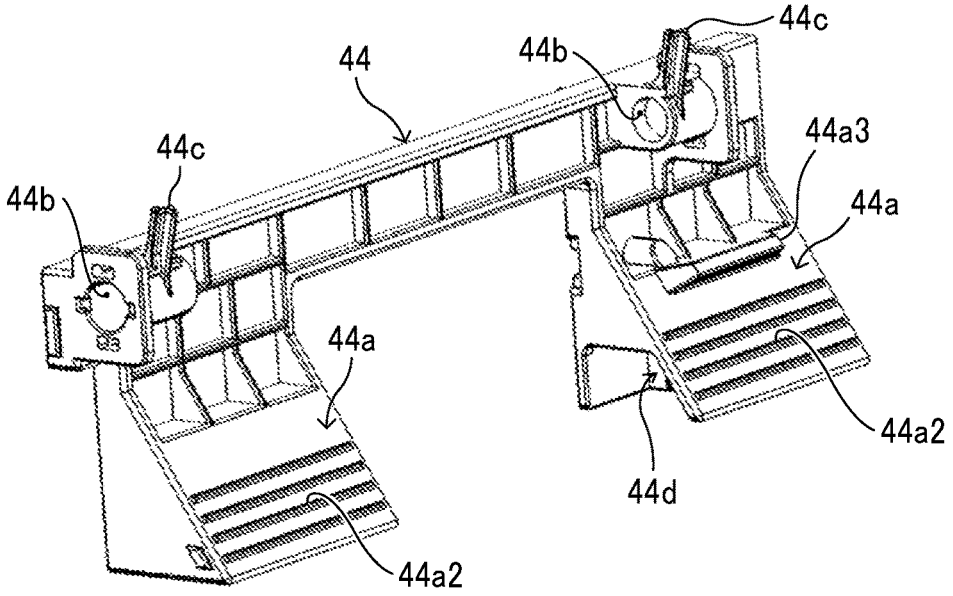
FIG. 8B is a perspective view illustrating the slider, viewed from another direction different from the direction of FIG. 8A.
Figure 8C:
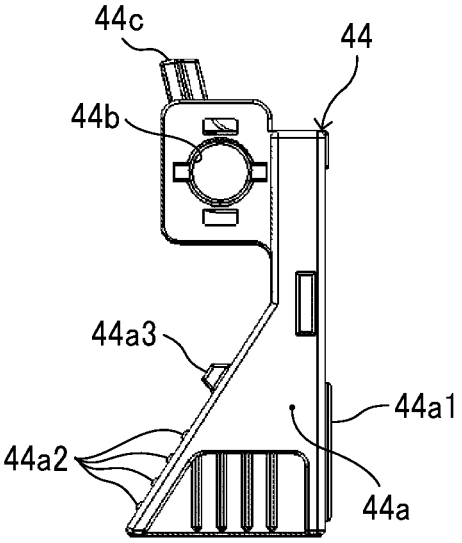
FIG. 8C is a side view illustrating the slider, viewed from the axial direction of a rotary shaft.

FIG. 7 is a bottom view illustrating the sheet ejection device 4 with the upper tray unit 41 being removed. FIGS. 8A and 8B are perspective views illustrating the slider 44, viewed from different directions from each other. FIG. 8C is a side view illustrating the slider 44, viewed from the axial direction of the rotary shaft 43*a*.

The slider 44 is attached to the tray securing unit 43 by inserting the rotary shaft 43*a* of the tray securing unit 43 into bearing holes 44*b* of the slider 44, so that the slider 44 slides along the axial direction (the Y direction) of the rotary shaft 43*a*. The slider 44 includes tray receiving portions 44*a*, each having a sliding face 44*a*1. The slider 44 slides in the Y direction while causing the sliding face 44*a*1 of the tray receiving portion 44*a* of the slider 44 to slide on a sliding target face 43*c* of the tray securing unit 43.

When the tray angle is a first angle α as illustrated in FIG. 5, the slider 44 is located at a first position (position in the Y direction) as illustrated in FIGS. 3 and 7. At this time, even when the downstream side portion of the upper tray unit 41 is attempted to rotate, together with the lower tray unit 42, about the rotary shaft 43*a* in a downward direction due to the own weight, a contact face 42*c* of the lower tray unit 42 contacts a contact target face 44*a*2 of the tray receiving portion 44*a* of the slider 44 so as to regulate the rotation of the downstream side portion of the upper tray unit 41. According to this action, the upper tray unit 41 is positioned to have the tray angle to be the first angle α. Contact of a rotation stopper 42*e* that is mounted on the side face of the lower tray unit 42 to the tray securing unit 43 regulates the lower tray unit 42 from rotating about the rotary shaft 43*a* in a direction to further increase the tray angle beyond the first angle α.

Figure 9:
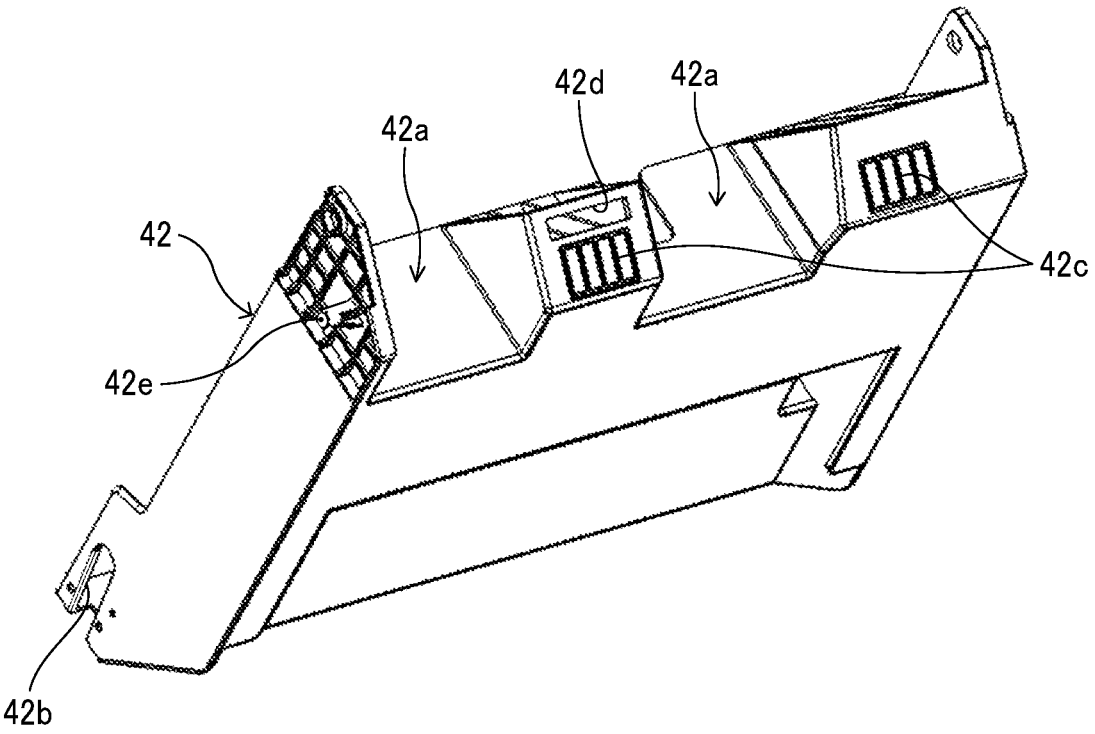
FIG. 9 is a perspective view illustrating a lower tray unit, viewed from obliquely below.
Figure 10:
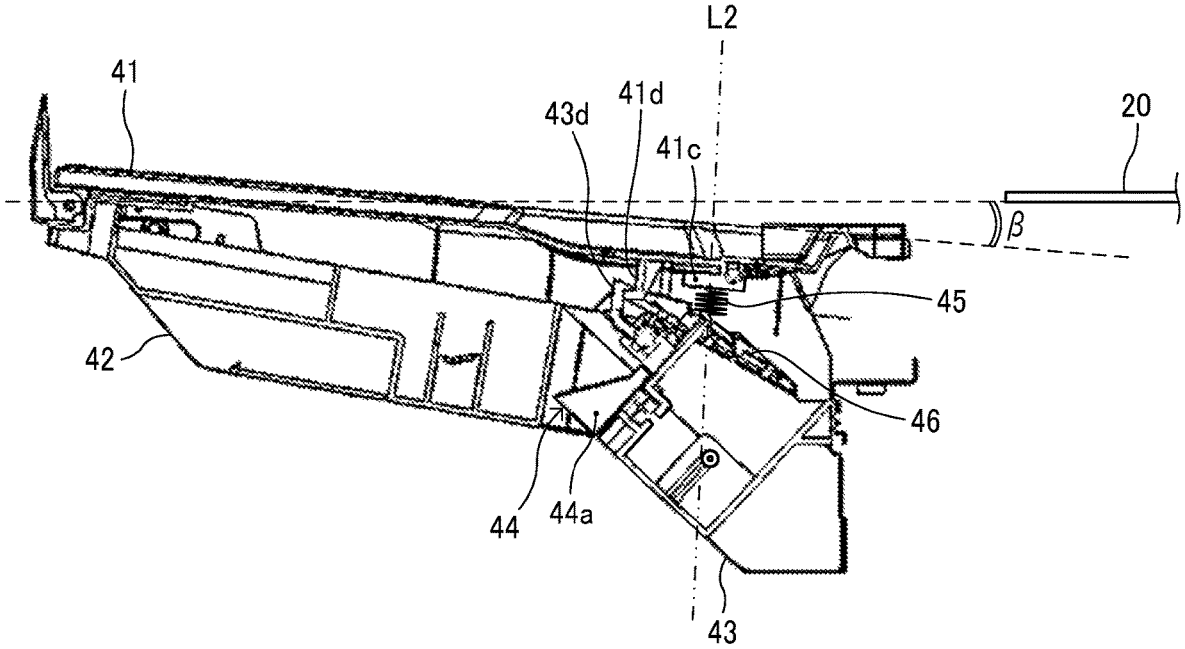
FIG. 10 is a cross-sectional view illustrating the sheet ejection tray having a second angle β as a tray angle, when the sheet ejection tray is cross-sectioned along the sheet conveyance direction.

FIG. 9 is a perspective view illustrating the lower tray unit 42, viewed from obliquely below. FIG. 10 is a cross-sectional view illustrating the sheet ejection device 4 having a second angle as a tray angle, when the sheet ejection device 4 is cross-sectioned along the sheet conveyance direction.

In a case in which the contact face 42*c* of the lower tray unit 42 and the contact target face 44*a*2 of the slider 44 are flat faces (plane), it is difficult to maintain the parallelism between the contact face 42*c* of the lower tray unit 42 and the contact target face 44*a*2 of the slider 44 due to manufacturing errors. Therefore, the contact state of the contact face 42*c* and the contact target face 44*a*2 does not stabilize, and the lower tray unit 42 rattles. In order to avoid this inconvenience, in the present embodiment, while a plurality of ribs extending in a direction perpendicular to the Y direction are mounted on the contact face 42*c* of the lower tray unit 42, as illustrated in FIG. 9, a plurality of ribs extending in the Y direction are mounted on the contact target face 44*a*2 of the slider 44, as illustrated in FIG. 8B. As described above, by contacting the plurality of ribs extending in different directions intersecting with each other, when compared with a configuration in which the flat faces contact with each other, the contact state of the contact face 42*c* of the lower tray unit 42 and the contact target face 44*a*2 of the slider 44 is easily stabilized, and therefore the rattle of the lower tray unit 42 is restrained.

Figure 11:
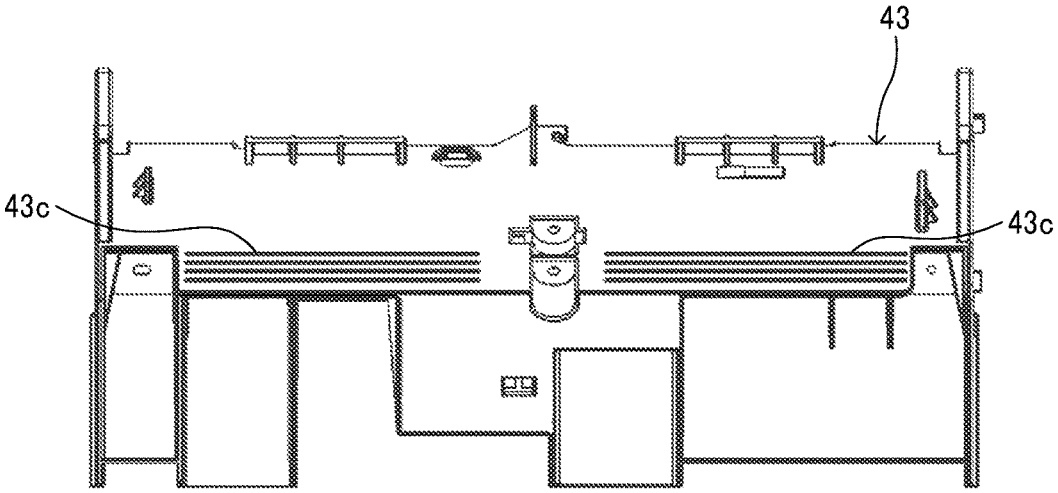
FIG. 11 is a top view illustrating a tray securing unit of the image forming apparatus.

On the other hand, when the tray angle is changed to a second angle β that is smaller than the first angle α, as illustrated in FIG. 10, a user pinches a handle 44*d* of the slider 44 to slide the slider 44 toward the front side of the image forming apparatus 1 along the Y direction (that is indicated by arrow C in FIGS. 3 and 7). Then, when the contact target face 44*a*2 of the tray receiving portion 44*a* of the slider 44 slidably reaches a second position (position in the Y direction) to displace (shift) from the opposing position to the contact face 42*c* of the lower tray unit 42, the tray receiving portion 44*a* comes to face a storage recess 42*a* of the lower tray unit 42. Therefore, even though the lower tray unit 42 has been restricted from rotating about the rotary shaft 43*a* in a direction to which the downstream side portion of the lower tray unit 42 lowers by the own weight, this restriction is cancelled according to this configuration. As a result, the lower tray unit 42 rotates until the contact face 42*c* of the lower tray unit 42 contacts the sliding target face 43*c* of the tray securing unit 43, the rotation of the lower tray unit 42 is regulated due to the contact, and the upper tray unit 41 is positioned to have the tray angle of the second angle β that is smaller than the first angle α. FIG. 11 is a top view illustrating the tray securing unit 43 of the image forming apparatus 1.

In a case in which the contact face 42*c* of the lower tray unit 42 and the sliding target face 43*c* of the tray securing unit 43 are flat faces (plane), it is difficult to maintain the parallelism between the contact face 42*c* of the lower tray unit 42 and the sliding target face 43*c* of the tray securing unit 43 due to manufacturing errors. Therefore, the contact state of the contact face 42*c* and the sliding target face 43*c* does not stabilize, and the lower tray unit 42 rattles. In the present embodiment, the plurality of ribs extending in the direction orthogonal to the Y direction are mounted on the contact face 42*c* of the lower tray unit 42, as described above. Therefore, as illustrated in FIG. 11, a plurality of ribs extending in the Y direction are provided on the sliding target face 43*c* of the tray securing unit 43. As described above, by contacting the plurality of ribs extending in different directions intersecting with each other, when compared with a configuration in which the flat faces contact with each other, the contact state of the contact face 42*c* of the lower tray unit 42 and the sliding target face 43*c* of the tray securing unit 43 is easily stabilized, and therefore the rattle of the lower tray unit 42 is restrained.

With respect to the sliding target face 43*c* of the tray securing unit 43 that contacts the contact face 42*c* of the lower tray unit 42 when the tray angle is the second angle β, in a case in which the slider 44 moves, the sliding face 44*a*1 of the slider 44 slides on the sliding target face 43*c* of the tray securing unit 43. Therefore, in the present embodiment, in order to reduce the sliding resistance and obtain the high slidability, the plurality of ribs on the sliding target face 43*c* extends in a (parallel) direction substantially same as a sliding direction in which the sliding face 44*a*1 of the slider 44 slides.

In the present embodiment, the first angle α is in a range of an angle applied when stacking general sheets (for example, the angle about 30° C.). When the tray angle is the first angle α as described above, when a sheet having a low stiffness and a large contact resistance, such as a coated thin paper, is conveyed, the leading end of the sheet in contact with the sheet stacking face of the upper tray unit 41 does not slidably climb up due to the high contact resistance and the trailing end of the sheet is fed to bend in a bellows shape due to the low stiffness.

According to the present embodiment, when a sheet having a low stiffness and a large contact resistance, such as thin paper coated paper, is conveyed, the slider 44 is slid from the first position to the second position to set the tray angle to the second angle β that is smaller than the first angle α. Accordingly, the angle of the upper face of the upper tray unit 41 becomes smaller (becomes parallel) with respect to the surface of the sheet 20 to be ejected (conveyed) through the sheet ejection port 2*a*. Therefore, even when a sheet having a high contact resistance and a low stiffness, such as a coated thin paper, is conveyed, the sheet stacking face of the upper tray unit 41 or the leading end of the sheet in contact with the sheet stacking face of the upper tray unit 41 slidably climbs up due to the feeding of the trailing end of the sheet, thereby restraining the bend of the sheet in a bellows shape.

The upper tray unit 41 has a spring receiving recess 41*c* to receive one end of the height adjuster spring 45. Here, when the tray angle is changed from the first angle α to the second angle β, the upper tray unit 41 rotates about the rotary shaft 43*a* via the lower tray unit 42. Consequently, the posture (angle) of the spring receiving recess 41*c* of the upper tray unit 41 changes, and therefore the spring receiving recess 41*c* of the upper tray unit 41 also changes. If this change is large, the biasing force of the height adjuster spring 45 acting on the spring receiving recess 41*c* of the upper tray unit 41 changes. As a result, when the tray angle is the second angle β, the height of the upstream portion of the upper tray unit 41 shifts from the target height, and therefore the sheet stacking performance (the sheet stackability) is degraded.

Specifically, when the tray angle is the second angle β, due to the change in the biasing force of the height adjuster spring 45, the height of the sheet stacking face of the upstream portion of the upper tray unit 41 or the height of the surface of the uppermost sheet on the upper tray unit 41 may be too low, with respect to the sheet 20 to be conveyed through the sheet ejection port 2*a*, for example. In this case, the leading end of the sheet 20 contacts the sheet stacking face of the upper tray unit 41 or the surface of the uppermost sheet while being hanged down by the own weight. Due to this contact of the sheet 20 with the upper tray unit 41 or the uppermost sheet, the trailing end of the sheet 20 is conveyed prior to (comes before) the leading end of the sheet 20 in the sheet conveyance direction, resulting in an inconvenience that the sheet 20 is curled up into a roll shape. Consequently, the sheet 20 is not conveyed appropriately.

Conversely, in a case in which he height of the sheet stacking face of the upper tray unit 41 or the height of the uppermost sheet is too high, the leading end of the sheet 20 collides the end face of the upper tray unit 41 or an end face of the sheet bundle loaded on the upper tray unit 41 prior to the upstream portion of the upper tray unit 41. Therefore, the sheet 20 is not conveyed appropriately to the upper tray unit 41.

For example, a known post-processing apparatus (that is, a known sheet stacker) includes a configuration in which a sheet ejection tray (that is, a sheet stacking member) moves in a vertical direction driven by a stepping motor. As the sheet stacking amount on the sheet ejection tray increases, the post-processing apparatus causes the stepping motor to lower the sheet ejection tray and, at the same time, increases the amount of electrical energy to supply to the stepping motor. In a case in which the post-processing apparatus has performed a sheet folding operation to a sheet to be ejected, the angle of the sheet stacking face of the sheet ejection tray relative to the folded sheet to be ejected is changed to be smaller than the angle of the angle of the sheet stacking face of the sheet ejection tray relative to an unfolded sheet to be ejected. Accordingly, misdetection of the sheet stacking amount of the folded sheets due to a small bulge of a folding portion of the sheet is eliminated, and therefore excessive power supply to the stepping motor is restrained.

In order to address this inconvenience, the sheet ejection device 4 according to the present embodiment includes a biasing force change reducer to reduce (restrain) the change of the biasing force acting on the upper tray unit 41 before and after the change of the tray angle. With this configuration, even if the tray angle is changed to the second angle β, the biasing force acting on the upper tray unit 41 does not largely change from the first angle α. Specifically, the biasing force change reducer according to the present embodiment includes a spring receiver 46 that functions as a coupling portion provided on the tray securing unit 43 to couple the tray securing unit 43 with the height adjuster spring 45. The biasing force change reducer changes the position of the spring receiver 46 before and after the change of the tray angle of the upper tray unit 41.

Figure 12A:
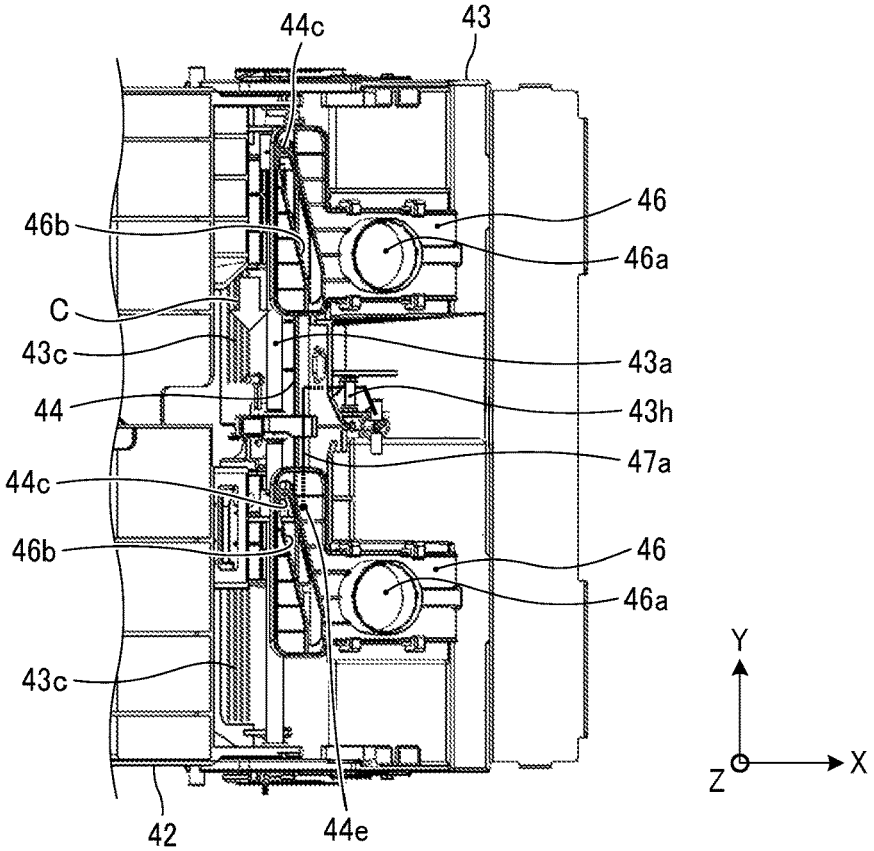
FIG. 12A is a top view illustrating the sheet ejection tray having the first angle α when the upper portion and a height adjuster spring are removed.
Figure 12B:
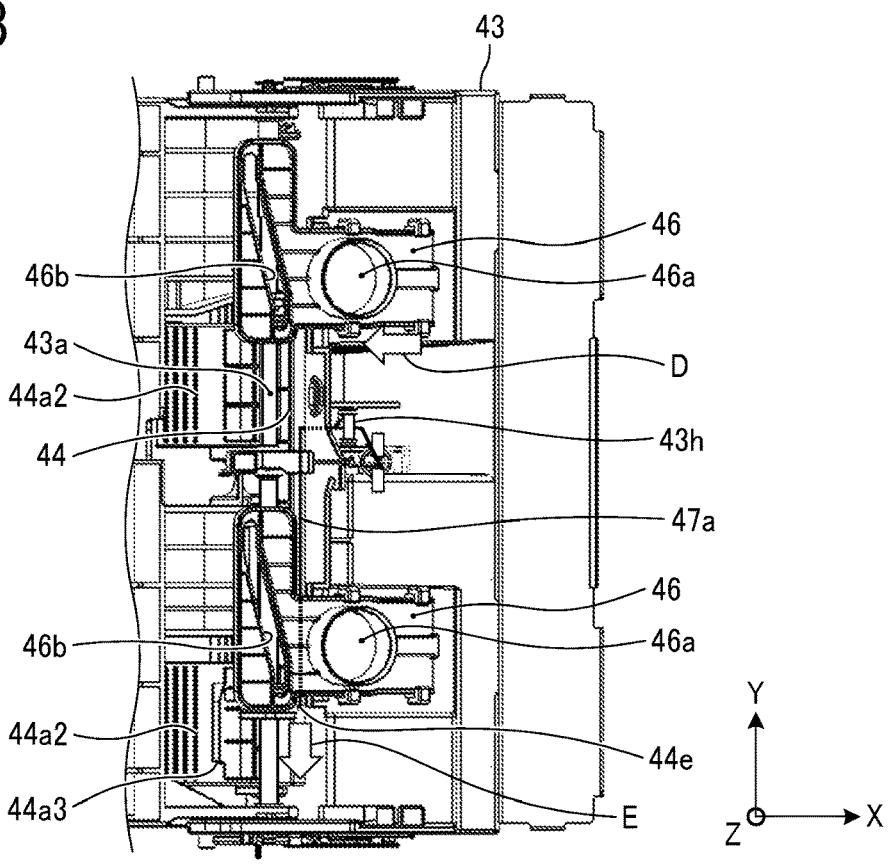
FIG. 12B is a top view illustrating the sheet ejection tray having the second angle β when the upper portion and the height adjuster spring are removed.
Figure 13A:
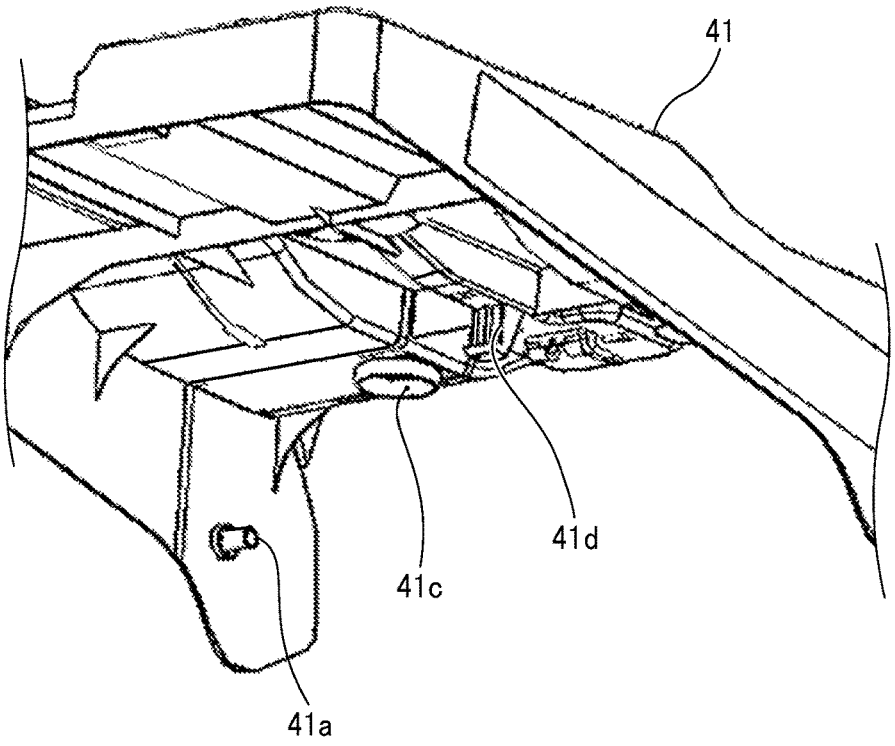
FIG. 13A is a perspective view illustrating the upper tray unit, viewed from a direction.
Figure 13B:
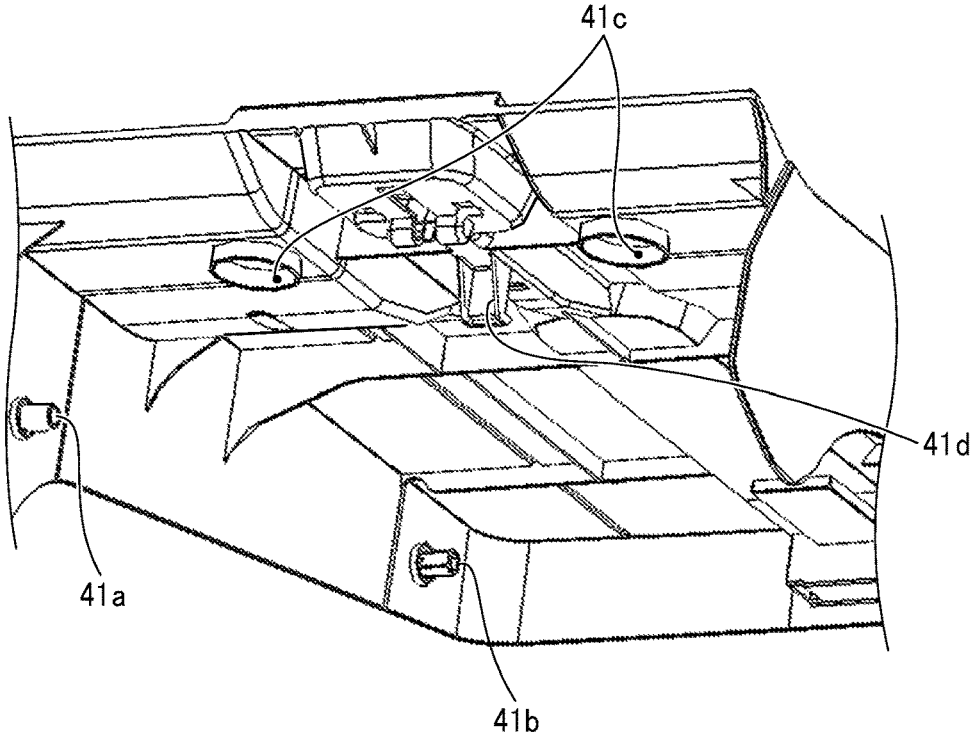
FIG. 13B is a perspective view illustrating the upper tray unit, viewed from another direction different from the direction of FIG. 13A.

FIGS. 12A and 12B are top views of the sheet ejection device 4 without the upper tray unit 41 and the height adjuster spring 45. Specifically, FIG. 12A illustrates the position of the spring receiver 46 when the tray angle of the upper tray unit 41 is at the first angle α and FIG. 12B illustrates the position of the spring receiver 46 when the tray angle of the upper tray unit 41 is at the second angle β. Further, FIGS. 13A and 13B are perspective views illustrating the upper tray unit 41, viewed from respective directions different from each other.

In the present embodiment, a lower end portion of the height adjuster spring 45 (that is, an end portion coupled to the tray securing unit 43) between the tray securing unit 43 and the upper tray unit 41 is disposed and held in a recess 46*a* of each of the spring receivers 46 that are held on the tray securing unit 43. Note that an upper end portion of the height adjuster spring 45 (that is, an end portion coupled to the upper tray unit 41) is disposed and held in the spring receiving recess 41*c* formed in the upper tray unit 41 as illustrated in FIGS. 13A and 13B.

Each of the spring receiving recesses 41*c* (in other words, each spring receiving recess 41*c*) has a receiving face to hold the upper end of the height adjuster spring 45. When the tray angle is the first angle α, the orientation of the receiving face of each spring receiving recess 41*c* of the upper tray unit 41 that holds the upper end of the height adjuster spring 45 directs in a direction indicated by reference letter L1 with a two-dot chain line (in other words, a line L1) in FIG. 5. On the other hand, when the upper tray unit 41 rotates about the rotary shaft 43*a* via the lower tray unit 42 to change the tray angle from the first angle α to the second angle β, the orientation of the receiving face of each spring receiving recess 41*c* of the upper tray unit 41 that holds the upper end of the height adjuster spring 45 directs in a direction indicated by reference letter L2 with a two-dot chain line (in other words, a line L2) in FIG. 10.

According to this configuration, in this embodiment, the position at which the line L2 passes through the tray securing unit 43 when the tray angle is the second angle β (see FIG. 10) is displaced (shifted) upstream in the sheet conveyance direction, far from the position at which the line L1 passes through the tray securing unit 43 at the first angle α when the tray angle is the first angle α (see FIG. 5). Due to this displacement (shift), the attitude (angle) of the height adjuster spring 45 with respect to the spring receiving recess 41*c* of the upper tray unit 41 changes, and the biasing force of the height adjuster spring 45 acting on the spring receiving recess 41*c* of the upper tray unit 41 also changes.

Therefore, in the present embodiment, the spring receivers 46 that receive and hold the respective lower ends of the height adjuster springs 45 are disposed to be slidable along substantially the X direction (the sheet conveyance direction) of the tray securing unit 43. Specifically, when the tray angle is the first angle α, each spring receiver 46 moves to a position illustrated in FIG. 12A. On the other hand, when the tray angle is the second angle β, each spring receiver 46 moves to a position illustrated in FIG. 12B. Accordingly, as the lower end of the height adjuster spring 45 displaces (shifts) in the sheet conveyance direction due to the change in the tray angle, the spring receiver 46 that receives the lower end of the height adjuster spring 45 also displaces (shifts) in the same direction as the lower end of the height adjuster spring 45. This movement restrains the change in the attitude (angle) of the height adjuster spring 45 with respect to the spring receiving recess 41*c* of the upper tray unit 41, and therefore reduces the change in the biasing force of the height adjuster spring 45 acting on the spring receiving recess 41*c* of the upper tray unit 41.

Further, the spring receiver 46 according to the present embodiment is configured to move (slide) along with movement of the slider 44 that moves when changing the tray angle. In other words, the position of the spring receiver 46 (coupling portion) changes along with movement of the slider 44. Specifically, as illustrated in FIGS. 12A and 12B, a projection 44*c* mounted on the slider 44 is engaged with a guide groove 46*b* mounted on the spring receiver 46. When the slider 44 slides from the first position (the first angle α) illustrated in FIG. 12A to the second position (the second angle β) illustrated in FIG. 12B (in a direction indicated by arrow C in FIG. 12A), the projection 44*c* that moves along the above-described movement of the slider 44 moves along the guide groove 46*b*. Accordingly, the spring receiver 46 moves in a direction indicated by arrow D in FIG. 12B. The guide groove 46*b* has a shape inclined to the sliding direction (that is, the Y direction) and the sheet conveyance direction (that is, the X direction). This shape of the guide groove 46*b* leads to achievement of the above-described interlocked movements.

Note that, in the configuration of the present embodiment, the spring receiver 46 that receives the lower end of the height adjuster spring 45 moves. However, in stead of this configuration or in addition to this configuration, the spring receiving recess 41*c* that receives the upper end of the height adjuster spring 45 may move.

Here, in the present embodiment, the height adjuster spring 45 is used to lower the upper tray unit 41 appropriately according to the sheet stacking amount when the tray angle is the first angle α. In the present embodiment, when the tray angle is changed from the first angle α to the second angle β, the upper tray unit 41 rotates about the rotary shaft 43*a* via the lower tray unit 42, so that the spring receiving recess 41*c* of the upper tray unit 41 that receives the upper end of the height adjuster spring 45 approaches the spring receiver 46 of the tray securing unit 43. Therefore, as the tray angle is changed from the first angle α to the second angle β, the biasing force applied by the height adjuster spring 45 to the upper tray unit 41 increases. Therefore, the biasing force of the height adjuster spring 45 acting on the spring receiving recess 41*c* of the upper tray unit 41 changes. As a result, when the tray angle is the second angle β, the upstream portion of the upper tray unit 41 is higher than the target position, which degrades the sheet stacking performance (sheet stackability).

In the present embodiment, the sheet ejection device further includes an upper limit height position regulator to regulate the upper limit height position of the upstream portion of the upper tray unit 41 so that the height of the upstream portion of the upper tray unit 41 at the first angle α is substantially the same as the height of the upstream portion of the upper tray unit 41 at the second angle β, in a state in which no sheet is stacked on the sheet stacking face of the upper tray unit 41.

Specifically, when the tray angle is the first angle α, the upstream side guide projection 41*a* of the upper tray unit 41 is pressed against (is in contact with) the upper end of the vertical guide groove 43*b* of the tray securing unit 43 due to the biasing force of the height adjuster spring 45, to regulate the upper limit height position of the upstream portion of the upper tray unit 41. On the other hand, when the tray angle is changed from the first angle α to the second angle β, the upper tray unit 41 rotates about the rotary shaft 43*a* via the lower tray unit 42. With this action, the upstream side end portion of the upper tray unit 41 that is located upstream from the rotary shaft 43*a* in the sheet conveyance direction moves upward. For this reason, while the upstream side guide projection 41*a* of the upper tray unit 41 remains pressed against the upper end of the vertical guide groove 43*b* of the tray securing unit 43, the height of the upstream portion of the upper tray unit 41 in the initial state (that is, a sheet unloaded state) changes to be higher than when the tray angle is the first angle α.

Therefore, the sheet ejection device 4 according to the present embodiment includes another upper limit height position regulator that is different from the vertical guide groove 43*b* of the tray securing unit 43, so that the height of the upstream portion of the upper tray unit 41 at the second angle β is substantially the same as the height of the upstream portion of the upper tray unit 41 at the first angle α in a state in which no sheet is stacked on the sheet stacking face of the upper tray unit 41.

Figure 14A:
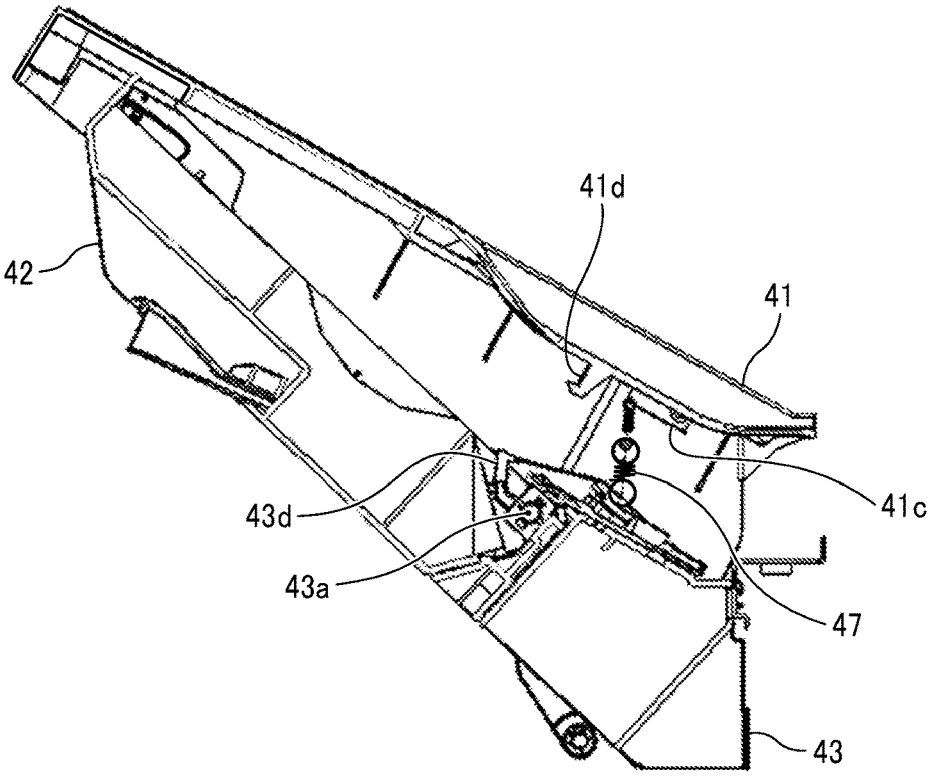
FIGS. 14A and 14B are cross-sectional views illustrating the sheet ejection tray that is cross-sectioned in a direction orthogonal to the sheet conveyance direction to indicate an upper height limit position regulator for a tray angle of the second angle β.
Figure 14B:
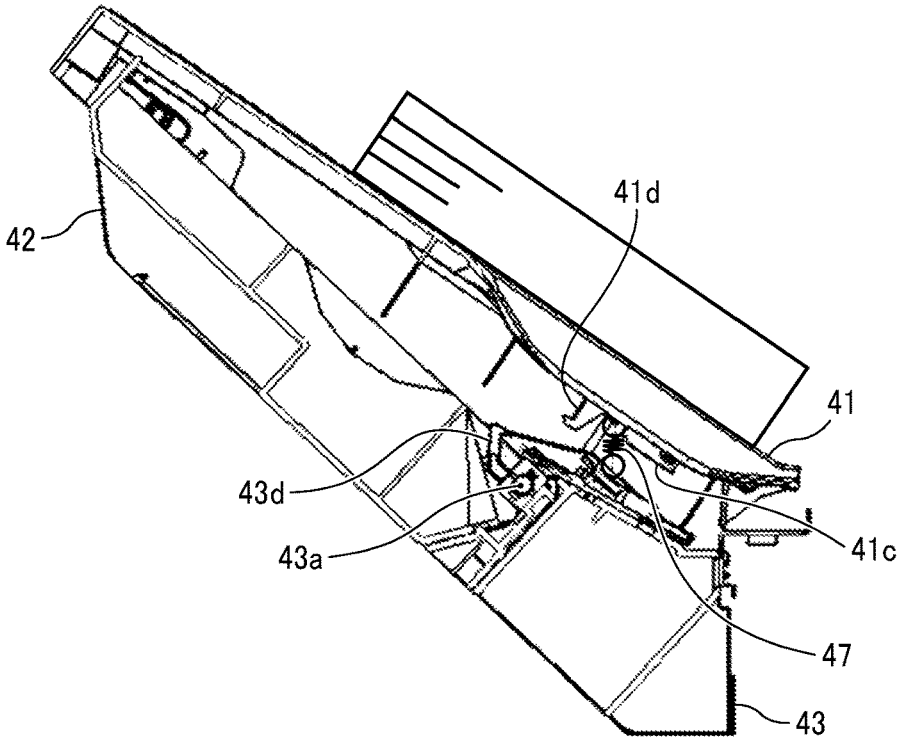

FIGS. 14A and 14B are cross-sectional views of the sheet ejection device 4 that is cross-sectioned in a direction orthogonal to the sheet conveyance direction to indicate the upper limit height position regulator having a tray angle of the second angle β.

In the present embodiment, the sheet ejection device 4 further includes an upper limit regulator hook 43*d* and a tray side hook 41*d*. The upper limit regulator hook 43*d* is mounted on the rotary shaft 43*a*. The tray side hook 41*d* is mounted on the upper tray unit 41 and is engaged with the upper limit regulator hook 43*d* when the tray angle is the second angle β. When the tray angle is the first angle α, the tray side hook 41*d* of the upper tray unit 41 is separated from the upper limit regulator hook 43*d* mounted on the rotary shaft 43*a* of the tray securing unit 43, even in the initial state as illustrated in FIG. 14A or a sheet stacking state (that is, a state in which the upstream side guide projection 41*a* is pressed against the lower end of the vertical guide groove 43*b*) as illustrated in FIG. 14B. Accordingly, when the tray angle is the first angle α, the tray side hook 41*d* of the upper tray unit 41 does not engage with the upper limit regulator hook 43*d* of the tray securing unit 43, and therefore does not regulate the upper limit height position of the upstream portion of the upper tray unit 41.

On the other hand, when the tray angle is changed from the first angle α to the second angle β, the upper tray unit 41 rotates about the rotary shaft 43*a* via the lower tray unit 42. With this action, the tray side hook 41*d* that is disposed downstream the rotary shaft 43*a* in the sheet conveyance direction and upper than the rotary shaft 43*a* moves toward downstream in the sheet conveyance direction while moving downward. Then, in the state of the second angle β, as the upper tray unit 41 is pressed down while the upstream side guide projection 41*a* of the upper tray unit 41 is regulated by the vertical guide groove 43*b* against the biasing force of the height adjuster spring 45, the tray side hook 41*d* of the upper tray unit 41 engages with the upper limit regulator hook 43*d* mounted on the rotary shaft 43*a* of the tray securing unit 43, as illustrated in FIG. 10. The upper tray unit 41 after being engaged with the upper limit regulator hook 43*d*, the tray side hook 41*d* is regulated by the upper limit regulator hook 43*d* so as not to displace (shift) further upwardly from the upper limit regulator hook 43*d*.

Figure 15:
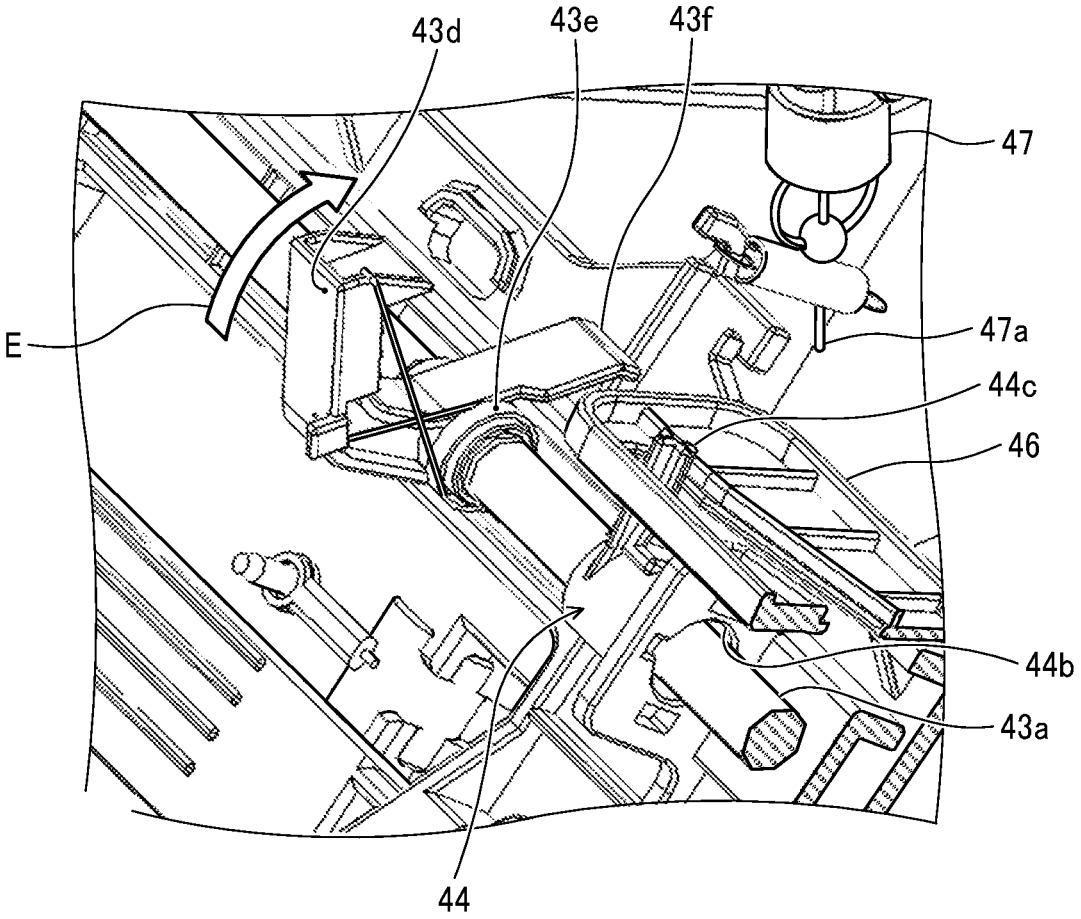
FIG. 15 is a perspective view illustrating a torsion spring that biases an upper limit regulation hook around the rotary shaft.
Figure 16A:
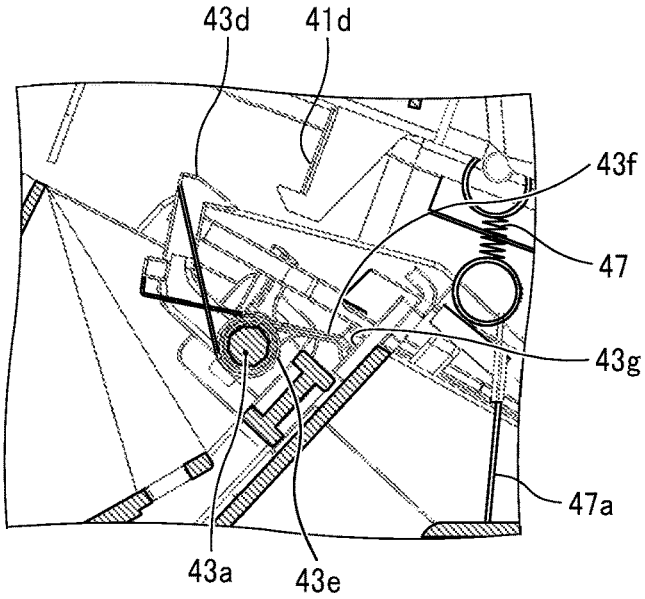
FIGS. 16A, 16B, and 16C are diagrams illustrating respective states of a tray side hook of the upper tray unit engaging the upper limit regulation hook.
Figure 16B:
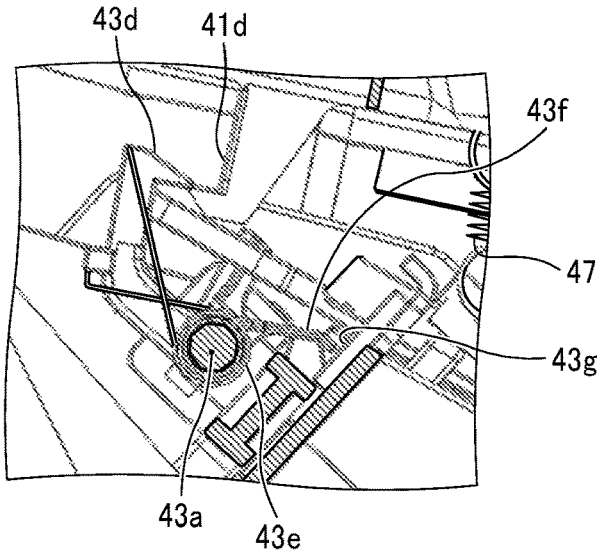
Figure 16C:
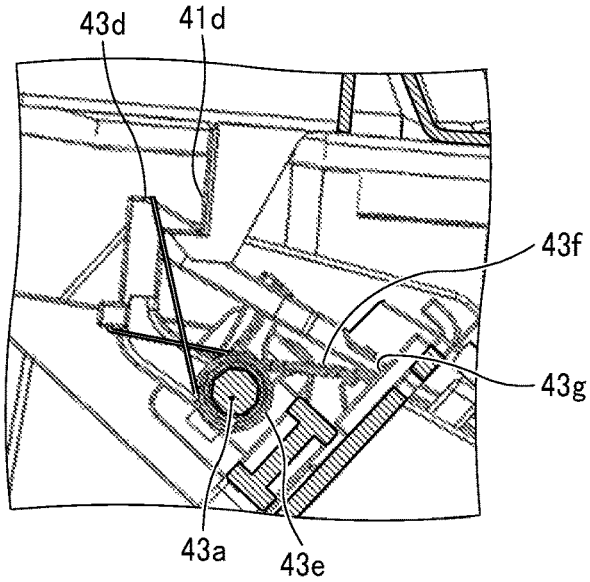

FIG. 15 is a perspective view illustrating a torsion spring 43*e* that biases the upper limit regulator hook 43*d* around the rotary shaft 43*a*. FIGS. 16A, 16B, and 16C are diagrams illustrating respective states of the tray side hook 41*d* of the upper tray unit 41 engaging with the upper limit regulator hook 43*d*.

As illustrated in FIG. 15, the upper limit regulator hook 43*d* according to the present embodiment is biased by the torsion spring 43*e* about the rotary shaft 43*a*, in a direction indicated by arrow E in FIG. 15. The upper limit regulator hook 43*d* is integrally provided with a contact portion 43*f*. When the tray side hook 41*d* is not engaged with the upper limit regulator hook 43*d*, the contact portion 43*f* contacts a contact target portion 43*g* of the tray securing unit 43, as illustrated in FIG. 16A, so as to position the position of rotation of the upper limit regulator hook 43*d*.

When the tray angle is changed to the second angle β and the upper tray unit 41 is pressed down against the biasing force of the height adjuster spring 45, the lower face of the tray side hook 41*d* of the upper tray unit 41 contacts the upper face of the upper limit regulator hook 43*d*. Then, as the upper tray unit 41 is further pressed down, the lower face of the tray side hook 41*d* slides on the upper face of the upper limit regulator hook 43*d*. According to this action, the upper limit regulator hook 43*d* rotates about the rotary shaft 43*a* in the counterclockwise direction in FIG. 16B, against the biasing force of the torsion spring 43*e*, as illustrated in FIG. 16B. When the upper limit regulator hook 43*d* rotates until the lower face of the tray side hook 41*d* slides outside the upper face of the upper limit regulator hook 43*d*, the upper limit regulator hook 43*d* rotates about the rotary shaft 43*a* in the clockwise direction in FIG. 16B, due to the biasing force of the torsion spring 43*e*. According to this action, the tray side hook 41*d* engages with the upper limit regulator hook 43*d*, so that the upper limit position of the upper tray unit 41 is regulated, as illustrated in FIG. 16C.

As a result, in a case in which the tray angle is changed to the second angle β, as the upper tray unit 41 is pressed down against the biasing force of the height adjuster spring 45, the tray side hook 41*d* engages with the upper limit regulator hook 43*d*. Accordingly, as illustrated in FIG. 10, the height of the upstream portion of the upper tray unit 41 in the initial state is substantially equal to the height when the tray angle is the first angle α (see FIG. 5).

By providing the upper limit height position regulator as described above, the height of the upstream portion of the upper tray unit 41 in the initial state (sheet unloaded state) is substantially equal between the first angle α and the second angle β. However, the amount of compression of the height adjuster spring 45 in the initial state (sheet unloaded state) is greater with the tray angle of the second angle β than with the tray angle of the first angle α. Therefore, the biasing force of the height adjuster spring 45 to the upper tray unit 41 is greater with the tray angle of the second angle β than with the tray angle of the first angle α. For this reason, after the sheets are stacked on the upper tray unit 41, the upper tray unit 41 at the first angle α lowers appropriately according to the amount of sheets stacked on the upper tray unit 41 to keep the height of the surface of the uppermost sheet within an appropriate range. By contrast, the upper tray unit 41 at the second angle β does not move down appropriately according to the number of sheets (sheet amount) stacked on the upper tray unit 41, and therefore the height of the surface of the uppermost sheet is not kept within the appropriate range.

In order to address this inconvenience, the biasing force change reducer according to the present embodiment further includes a biasing force adjuster spring 47 that functions as a different biasing member (in other words, another biasing force applier) different from the height adjuster spring 45. The biasing force adjuster spring 47 biases the upper tray unit 41 downward when the tray angle is the second angle β. In other words, the biasing force adjuster spring 47 applies a biasing force different from the height adjuster spring 45, to bias the upper tray unit 41, before and after the change of the angle of the upper tray unit 41 by the slider 44, to restrain the change of the biasing force acting on the upper tray unit 41.

Figure 17:
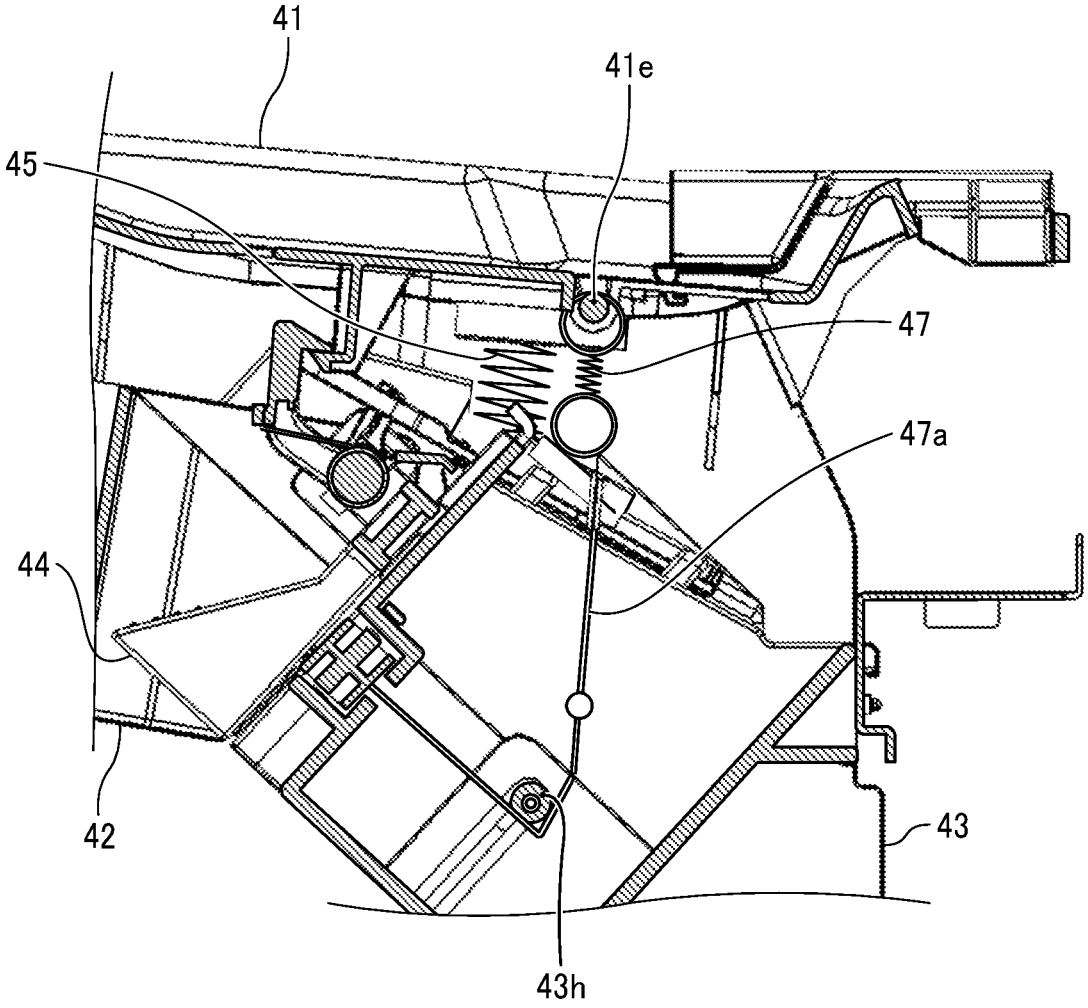
FIG. 17 is a side view illustrating a biasing force adjuster spring disposed inside the sheet ejection tray.

FIG. 17 is a side view illustrating the biasing force adjuster spring 47 that is disposed inside the sheet ejection device 4.

As illustrated in FIG. 17, the biasing force adjuster spring 47 is a tension spring having the upper end attached to a spring attaching portion 41*e* of the upper tray unit 41 and the lower end attached to a wire 47*a* that functions as a biasing member. The wire 47*a* is wound around a pulley 43*h* that is provided in the tray securing unit 43. The wire 47*a* has one end attached to the lower end of the biasing force adjuster spring 47 and the opposite end attached to a spring attaching portion 44*e* of the slider 44, as illustrated in FIGS. 12A and 12B.

In the present embodiment, when the slider 44 is at the first position (the first angle α), the wire 47*a* attached to the spring attaching portion 44*e* on the slider 44 goes slack, in other words, maintains a loosened state. Therefore, when the tray angle is the first angle α, the biasing fore of the biasing force adjuster spring 47 does not act on the upper tray unit 41. As a result, the biasing force of the height adjuster spring 45 alone acts on the upper tray unit 41.

On the other hand, when the slider 44 slides from the first position to the second position, the wire 47*a* attached to the spring attaching portion 44*e* on the slider 44 is pulled together with the slider 44. As a result, the biasing force adjuster spring 47, which has one end attached to the spring attaching portion 41*e* of the upper tray unit 41, extends. Therefore, when the tray angle is turned to the second angle β, the biasing force of the biasing force adjuster spring 47 acts on the upper tray unit 41, so that the biasing force is applied to bias the upper tray unit 41 downward. As a result, when the tray angle is the second angle β, part of the biasing force of the height adjuster spring 45 to bias the upper tray unit 41 upward is cancelled (offset) by the biasing force of the biasing force adjuster spring 47 to bias the upper tray unit 41 downwardly. Accordingly, the biasing force to bias the upper tray unit 41 upward is weakened (reduced) when compared with the case in which the biasing force of the height adjuster spring 45 alone is applied to the upper tray unit 41.

In the present embodiment, the characteristics of the biasing force adjuster spring 47 and the pulling amount of the wire 47*a* are appropriately determined to adjust the biasing force, so as to apply the appropriate amount of the biasing force to the upper tray unit 41 when the tray angle is the second angle β. As a result, even at the second angle β, the upper tray unit 41 lowers appropriately according to the sheet stacking amount, and therefore the height of the surface of the uppermost sheet is maintained within an appropriate range.

Note that, in the present embodiment, the biasing force of the biasing force adjuster spring 47 to the upper tray unit 41 is switched (changed) together with movement of the slider 44. That is, the position of the biasing force adjuster spring 47 changes along with movement of the slider 44. In other words, the biasing force adjuster spring 47 switches whether or not said another biasing member applies the biasing force to the upper tray unit 41, before and after the change of the angle of the upper tray unit 41 by the slider 44, to restrain the change of the biasing force acting on the upper tray unit 41. However, the configuration is not limited to the above-described configuration. For example, the biasing force of the biasing force adjuster spring 47 to the upper tray unit 41 may be switched (changed) together with movement of a different member or a retainer (such as the spring receiver 46 and the upper tray unit 41) or may be switched (changed) manually.

Further, in the present embodiment, when the slider 44 is at the first position (the first angle α), the biasing force of the biasing force adjuster spring 47 does not act on the upper tray unit 41. However, as an alternative configuration, the biasing force of the biasing force adjuster spring 47 may act on the upper tray unit 41 even when the slider 44 is at the first position (the first angle α).

In the present embodiment, when the tray angle is changed from the second angle β to the first angle α, the following operations are performed. When the tray angle is the second angle β, the tray receiving portion 44*a* of the slider 44 located on the second position is fit in the storage recess 42*a* of the lower tray unit 42, which prevents the slider 44 from sliding to the first position. Therefore, when the tray angle is changed from the second angle β to the first angle α, a user lifts the lower tray unit 42. Accordingly, the tray receiving portion 44*a* of the slider 44 comes out of the storage recess 42*a* of the lower tray unit 42, which allows the slider 44 to slide to the first position.

Here, the user may pinch the handle 44*d* of the slider 44 to slide the slider 44 in the Y direction, toward the rear side of the sheet ejection device 4 (to the first position). However, in the present embodiment, the slider 44 slides to the first position due to the biasing force of a compression spring 44*f* that functions as a slider biasing member, in order to enhance the convenience of the user. Specifically, the compression spring 44*f* is mounted on the rotary shaft 43*a* to bias the slider 44 along the axial direction (the Y direction) of the rotary shaft 43*a*, to the rear side of the sheet ejection device 4 (to the first position).

When changing the tray angle from the first angle α to the second angle β, the user pinches the handle 44*d* of the slider 44 to slide the slider 44 to the front side of the sheet ejection device 4, against the biasing force of the compression spring 44*f* Accordingly, the slider 44 moves to the second position, so that the tray receiving portion 44*a* of the slider 44 fits into the storage recess 42*a* of the lower tray unit 42. Therefore, the upper tray unit 41 rotates about the rotary shaft 43*a* via the lower tray unit 42, and therefore the tray angle comes to the second angle β. At this time, the biasing force to the rear side of the sheet ejection device 4 (in other words, the biasing force to the first position) acts on the slider 44 due to the biasing force of the compression spring 44*f*. However, since the tray receiving portion 44*a* of the slider 44 contacts the inner wall of the storage recess 42*a* of the lower tray unit 42 to regulate movement of the slider 44 to the rear side of the sheet ejection device 4, the slider 44 is positioned to the second position.

On the other hand, when the tray angle is changed from the second angle β to the first angle α, the user lifts the lower tray unit 42. As a result, the tray receiving portion 44*a* of the slider 44 comes out of the storage recess 42*a* of the lower tray unit 42, so that the slider 44 is free to move to the rear side of the sheet ejection device 4. Therefore, the slider 44 slides to the rear side of the sheet ejection device 4 due to the biasing force of the compression spring 44*f* to move to the first position.

According to this configuration, when the tray angle is changed to the first angle α to the second angle β, the user performs only a simple operation in which the user pinches the handle 44*d* of the slider 44 to slide the slider 44 to the front side of the sheet ejection device 4, against the biasing force of the compression spring 44*f*. In other words, with the operation in which the slider 44 slides toward the front side of the sheet ejection device 4, the lower tray unit 42 rotates about the rotary shaft 43*a* by the own weight to change the tray angle to the second angle β. Further, by performing the operation to slide the slider 44 toward the front side of the sheet ejection device 4, the wire 47*a* is pulled to cause the biasing force of the biasing force adjuster spring 47 to act on the upper tray unit 41. According to this operation, the part of the biasing force of the height adjuster spring 45 to bias the upper tray unit 41 upward is cancelled (offset) by the biasing force of the biasing force adjuster spring 47 to bias the upper tray unit 41 downwardly. Then, the user performs a simple operation to press down the upper tray unit 41 to engage the tray side hook 41*d* of the upper tray unit 41 with the upper limit regulator hook 43*d* of the tray securing unit 43, so that the height of the upstream portion of the upper tray unit 41 comes to the target height.

In addition, when the tray angle is changed to the second angle β to the first angle α, the user performs only a simple operation in which the user lifts the lower tray unit 42. That is, by simply lifting the lower tray unit 42, the slider 44 automatically returns to the first position due to the biasing force of the compression spring 44*f* and the wire 47*a* is loosened along with the movement of the slider 44. Accordingly, the biasing force of the biasing force adjuster spring 47 does not act on the upper tray unit 41. Further, as the user lifts the lower tray unit 42, the upper tray unit 41 rotates about the rotary shaft 43*a*. As a result, the tray side hook 41*d* of the upper tray unit 41 comes off from the upper limit regulator hook 43*d* of the tray securing unit 43 to release the engagement, so that the upstream portion of the upper tray unit 41 comes to the target height.

Here, when the user lifts the lower tray unit 42, the tray receiving portion 44*a* of the slider 44 contacts the inner wall of the storage recess 42*a* of the lower tray unit 42 due to the biasing force of the compression spring 44*f*. Therefore, the slider 44 slightly rotates about the rotary shaft 43*a* following the movement of the lower tray unit 42. The above-described rotation is made due to a given gap (backlash) that needs to be provided between the sliding face 44*a*1 and the sliding target face 43*c* so that the slider 44 slides on the rotary shaft 43*a* while the sliding face 44*a*1 of the slider 44 attached to the rotary shaft 43*a* slides on the sliding target face 43*c* of the tray securing unit 43.

In order to restrain rotation of the slider 44 along with the movement of the lower tray unit 42, for example, a configuration in which the gap (backlash) between the sliding face 44*a*1 and the sliding target face 43*c* is filled when the slider 44 is at the second position may be applied. As a specific example, a projection is provided on the sliding face 44*a*1, of the plurality of sliding faces 44*a*1 of the slider 44, that approaches the sliding target face 43*c* when the slider 44 is rotated with rotation of the rotary shaft 43*a* or on the sliding target face 43*c*, of the plurality of sliding target faces 43*c* of the tray securing unit 43, that faces the sliding face 44*a*1 when the slider 44 is at the second position. With the contact of the projection, the slider 44 is restrained or prevented from rotating together with the rotary shaft 43*a*.

As illustrated in FIG. 8B, a stopper projection 44*a*3 is provided on the tray receiving portion 44*a* of the slider 44. When the contact face 42*c* of the lower tray unit 42 contacts the contact target face 44*a*2 of the slider 44, the stopper projection 44*a*3 fits into a stopper recess 42*d* (see FIG. 9) that is formed in a corresponding portion of the lower tray unit 42. With this configuration, when the contact face 42*c* of the lower tray unit 42 is in contact with the contact target face 44*a*2 of the slider 44 (in other words, when the tray angle is the first angle α), the slider 44 is regulated from sliding toward the front side of the sheet ejection device 4 (the second position). Accordingly, this configuration prevents the slider 44 from unintentionally sliding toward the front side of the sheet ejection device 4 (the second position), and therefore avoids the upper tray unit 41 and the lower tray unit 42 from dropping (lowering) suddenly.

Note that the stopper projection 44*a*3 has a sloped end face on the rear side of the sheet ejection device 4, as illustrated in FIG. 8B, and therefore, when the slider 44 slides to the rear side of the sheet ejection device 4 (the first side) due to the biasing force of the compression spring 44*f*, the end portion of the stopper projection 44*a*3 on the rear side of the sheet ejection device 4 is prevented from being caught by the wall face of the lower tray unit 42.

Further, when the upper tray unit 41 and the lower tray unit 42 are heavy, in order to change the tray angle from the first angle α to the second angle β, it is likely that the lower tray unit 42 abruptly rotates when the tray receiving portion 44*a* of the slider 44 enters the storage recess 42*a* of the lower tray unit 42. In such a case, for example, a biasing member such as a torsion spring to bias the lower tray unit 42 may be provided around the rotary shaft 43*a* in a direction in which the downstream side portion of the lower tray unit 42 moves upward. According to this configuration, when the tray angle is changed from the first angle α to the second angle β, the lower tray unit 42 is restrained from abruptly rotating.

The configurations according to the above-descried embodiments are not limited thereto. This disclosure can achieve the following aspects effectively.

Aspect 1.

In a sheet stacker (for example, the sheet ejection device 4) of Aspect 1 includes a sheet stacking member (for example, the upper tray unit 41), a biasing force applier (for example, the height adjuster spring 45), an angle changer (for example, the slider 44), and a biasing force change reducer (for example, the spring receiver 46 and the biasing force adjuster spring 47). The sheet stacking member has an upstream portion in a sheet conveyance direction. The upstream portion of the sheet stacking member is movable in a vertical direction. The biasing force applier is configured to bias the sheet stacking member upward. The angle changer is configured to change an angle of the sheet stacking face of the sheet stacking member, relative to a surface of a sheet (for example, the sheet 20) conveyed through a sheet conveying portion (for example, the sheet ejection port 2*a*). The biasing force change reducer is configured to restrain a change of a biasing force acting on the sheet stacking member, before and after a change of the angle of the sheet stacking face of the sheet stacking member by the angle changer.

When the angle changer changes the angle of the sheet stacking face of the sheet stacking member, the attitude (position) of the sheet stacking member may change relative to the biasing member, and therefore the biasing force to be applied from the biasing member to the sheet stacking member may change. In this case, the height of the upstream portion in the sheet conveyance direction of the sheet stacking member (in other words, the height of the portion to which the leading end of the sheet conveyed from the sheet conveying portion contacts) is displaced (shifted) from the target height, resulting in degradation of the sheet stacking performance (the sheet stackability) at the angle before and after the change of the angle.

Specifically, for example, in a case in which the height of the sheet stacking member of the upstream portion of the sheet stacking member in the sheet conveyance direction or the height of the surface of the uppermost sheet of the sheets stacked on the sheet stacking member is too low with respect to the sheet to be conveyed from the sheet conveying portion, the leading end of the sheet contacts the sheet stacking face or the surface of the uppermost sheet while being hanged down by the own weight. Therefore, the trailing end of the sheet is conveyed prior to the leading end of the sheet in the sheet conveyance direction, and the sheet is curled up into a roll shape. Conversely, in a case in which he height of the sheet stacking face of the sheet stacking member or the height of the surface of the uppermost sheet is too high, the leading end of the sheet collides the end face of the sheet stacking member or an end face of the sheet bundle loaded on the sheet stacking member prior to the upstream portion of the sheet stacking member. Therefore, the sheet is not conveyed appropriately to the sheet stacking face of the sheet stacking member.

In Aspect 1, even if the angle of the sheet stacking face of the sheet stacking member is changed by the angle changer, the change in the biasing force acting on the sheet stacking member is restrained (reduced) by the biasing force change reducer. According to this configuration, the height of the upstream portion in the sheet conveyance direction of the sheet stacking member is restrained from being displaced (shifted) from the target height. Accordingly, the preferable sheet stacking performance (the preferable sheet stackability) is obtained at the angle before and after the change of the angle.

Aspect 2.

In Aspect 2, the sheet stacker (for example, the sheet ejection device 4) of Aspect 1 further includes a securing member (for example, the tray securing unit 43) configured to attached to an image forming apparatus (for example, the image forming apparatus 1) and support the sheet stacking member. The biasing force applier (for example, the height adjuster spring 45) includes a biasing member (for example, the height adjuster spring 45) disposed between the sheet stacking member (for example, the upper tray unit 41) and the securing member. The biasing force change reducer (for example, the biasing force adjuster spring 47) includes a coupling portion (for example, the spring receiver 46) configured to couple the securing member with the biasing member. The biasing force change reducer is configured to change a position of the coupling portion with respect to the biasing member on at least one of the sheet stacking member and the securing member, before and after the change of the angle of the sheet stacking member by the angle changer (44), to restrain the change of the biasing force acting on the sheet stacking member.

In Aspect 2, the angle changer changes the attitude (position) of the sheet stacking member before and after the change of the angle of the sheet stacking face of the sheet stacking member, so as to change the orientation or position of the coupling portion of the sheet stacking member to which the biasing member is coupled. Thus, the attitude (position) of the biasing member with respect to the coupling portion before and after the change in the angle of the sheet stacking member, and therefore the biasing force applied by the biasing member to the sheet stacking member changes.

According to Aspect 2, the biasing force change reducer changes the position of the coupling portion with the biasing member on at least of one of the sheet stacking member and the securing member before and after the change of the angle of the sheet stacking member by the angle changer. According to this configuration, when compared with the configuration in which the position of the coupling portion is fixed, the change of the attitude (position) of the biasing member to the coupling portion of the sheet stacking member is reduced before and after the change of the angle by the angle changer. Accordingly, Therefore, the change in the biasing force acting on the sheet stacking member is restrained (reduced) by the angle changer is restrained before and after the change of the angle of the sheet stacking member.

Aspect 3.

In Aspect 3 according to Aspect 2, the angle changer (for example, the slider 44) includes an angle changing member (for example, the slider 44) movable relative to the sheet stacking member (for example, the upper tray unit 41). The angle changer (44) is configured to move the angle changing member (44) to a first position to maintain the angle to a first angle and move the angle changing member (44) to a second position to maintain the angle to a second angle. A position of the coupling portion (for example, the spring receiver 46) changes along with movement of the angle changing member.

According to this configuration, the movement of the angle changing member is performed along with the change in the position of the coupling portion. Accordingly, a simple mechanism and simple operations by a user are achieved.

Aspect 4.

In Aspect 4 according to any one of Aspects 1 to 3, wherein the biasing force change reducer (for example, the biasing force adjuster spring 47) further includes another biasing force applier (for example, the biasing force adjuster spring 47) different from a biasing force of the biasing force applier (for example, the height adjuster spring 45) and is configured to bias the sheet stacking member (for example, the upper tray unit 41) in the vertical direction. Said another biasing force applier is configured to apply a biasing force different from a biasing force of the biasing force applier, to bias the sheet stacking member, before and after the change of the angle of the sheet stacking member by the angle changer (for example, the slider 44), to restrain the change of the biasing force acting on the sheet stacking member.

As in Aspect 4, with said another biasing member, the change of the biasing member acting on the sheet stacking member is rested before and after the change of the angle of the sheet stacking member by the angle changer. Accordingly, a simpler configuration is achieved when compared with the configuration in which the biasing force of the biasing member to move the sheet stacking member upward is changed before and after the change of the angle by the angle changer.

Aspect 5.

In Aspect 5 according to Aspect 4, wherein the angle changer (for example, the slider 44) includes an angle changing member (for example, the slider 44) movable relative to the sheet stacking member (for example, the upper tray unit 41). The angle changer is configured to move the angle changing member to a first position to maintain the angle to a first angle and move the angle changing member to a second position to maintain the angle to a second angle. The position of said another biasing force applier (for example, the biasing force adjuster spring 47) changes along with movement of the angle changing member.

According to this configuration, the movement of the angle changing member is performed along with the change (switch) of the biasing force of said another biasing member. Accordingly, a simple mechanism and simple operations by a user are achieved.

Aspect 6.

In Aspect 6 according to Aspect 5, said another biasing force applier (for example, the biasing force adjuster spring 47) includes a biasing member (for example, the wire 47*a*) having one end coupled to the sheet stacking member (for example, the upper tray unit 41) and an opposite end coupled to the angle changer.

According to this configuration, a simpler configuration is achieved for the change (switch) of the biasing force of said another biasing member acting on the sheet stacking member performed along with the movement of the angle changing member.

Aspect 7.

In Aspect 7 according to any one of Aspects 4 to 6, the biasing force change reducer (for example, the biasing force adjuster spring 47) is configured to switch between a state in which said another biasing force applier applies the biasing force to the sheet stacking member (for example, the upper tray unit 41) and a state in which said another biasing force applier does not apply the biasing force to the sheet stacking member, before and after the change of the angle of the sheet stacking member by the angle changer (for example, the slider 44), to restrain the change of the biasing force acting on the sheet stacking member.

Accordingly, it is possible to employ a configuration in which the biasing force of said another biasing member does not act on the sheet stacking member when the angle changing member is at one of the first position and the second position and the biasing force of said another biasing member acts on the sheet stacking member when the angle changing member is the other position of the first position and the second position.

Aspect 8.

In Aspect 8 according to any one of Aspects 1 to 7, the angle changer (for the slider 44) includes an angle changing member (for example, the slider 44) movable relative to the sheet stacking member (for example, the upper tray unit 41). The angle changer is configured to move the angle changing member to a first position to maintain the angle to a first angle while the sheet stacking member is retained by the angle changer and move the angle changing member to a second position to maintain the angle to a second angle while the sheet stacking member is not retained by the angle changer (44) and is retained by a retainer (for example, the tray securing unit 43). The sheet stacking member has a contact face (for example, the contact face 42*c*) on which a plurality of ribs is disposed extending in a given direction and the angle changer has a contact target face (for example, the contact target face 44*a*2) on which a plurality of ribs is disposed extending in a direction intersecting the given direction of the plurality of ribs of the contact face. The angle changing member is at the first position, the angle changer is configured to maintain the angle to the first angle in a state in which the plurality of ribs of the contact face is in contact with the plurality of ribs on the contact target face.

According to this configuration, when compared with a configuration to maintain the flat faces in contact with each other at the first angle, the contact state of the sheet stacking member and the angle changing member is stabilized easily, and therefore the backlash between the sheet stacking member and the angle changing member is restrained easily.

Aspect 9.

In Aspect 9 according to any one of Aspects 1 to 8, the angle changer (for example, the slider 44) includes an angle changing member (for example, the slider 44) movable relative to the sheet stacking member (for example, the upper tray unit 41). The angle changer is configured to move the angle changing member to a first position to maintain the angle to a first angle while the sheet stacking member is retained by the angle changer and move the angle changing member to a second position to maintain the angle to a second angle while the sheet stacking member is not retained by the angle changer and is retained by the retainer (for example, the tray securing unit 43). The sheet stacking member has a contact face (for example, the contact face 42*c*) on which a plurality of ribs is disposed extending in a given direction and the retainer has a sliding target face (for example, the sliding target face 43*c*) on which a plurality of ribs is disposed extending in a direction intersecting the given direction of the plurality of ribs of the contact face. When the angle changing member is at the second position, the angle changer is configured to maintain the angle to the second angle in a state in which the plurality of ribs of the contact face is in contact with the plurality of ribs on the sliding target face.

According to this configuration, when compared with a configuration to maintain the flat faces in contact with each other at the second angle, the contact state of the sheet stacking member and the retainer is stabilized easily, and therefore the backlash between the sheet stacking member and the retainer is restrained easily.

Aspect 10.

In Aspect 10, the sheet stacker (for example, the sheet ejection device 4) according to any one of Aspects 1 to 9 includes an upper height limit position regulator (for example, the vertical guide groove 43*b*, the upper limit regulator hook 43*d*) configured to regulate an upstream portion in the sheet conveyance direction of the sheet stacking member (for example, the upper tray unit 41), before a change of an angle by the angle changer (for example, the slider 44) to be an equal upper height limit portion to the upstream portion in the sheet conveyance direction of the sheet stacking member, after the change of the angle by the angle changer.

According to this configuration, the height of the upstream portion of the sheet stacking member in the sheet conveyance direction in the initial state (the sheet unloaded state) is substantially equal before and after the change of the angle by the angle changer.

Aspect 11.

In Aspect 11 according to any one of Aspects 1 to 10, the angle changer (for example, the slider 44) is rotatably disposed relative to the securing member (for example, the tray securing unit 43). The angle changer includes a rotary support (for example, the lower tray unit 42) configured to support the sheet stacking member rotatably in a vertical direction and configured to change a rotational angle of the rotary support to change the angle of the sheet stacking face of the sheet stacking member (for example, the upper tray unit 41).

According to this configuration, the sheet stacker (for example, the sheet ejection device) easily achieves the function of the biasing force applier to bias the sheet stacking member in the vertical direction and the function of the angle changer to change the angle of the sheet stacking face of the sheet stacking member with respect to the surface of the sheet to be conveyed through the sheet conveying portion.

Aspect 12.

In Aspect 12 according to any one of Aspects 1 to 11, as the position of the sheet stacking member (for example, the upper tray unit 41) shifts downward, the sheet stacking member moves toward downstream in the sheet conveyance direction.

According to this configuration, when the sheet stacking member direction moves downward, the upstream portion of the sheet stacking member in the sheet conveyance direction is prevented from interfering the member on the sheet conveying portion. Accordingly, the sheet stacking member moves stably in the vertical direction.

Aspect 13.

In Aspect 13, an image forming apparatus (for example, the image forming apparatus 1) includes an image bearer (for example, the photoconductors 12Y, 12C, 12M, and 12K) and the sheet stacker (for example, the sheet ejection device 4). The image bearer is configured to form an image on a sheet (the sheet 20). The sheet stacker (for example, the sheet ejection device 4) according to any one of claims 1 o 12, configured to stack the sheet (for example, the sheet 20) having the image formed by the image bearer.

According to this configuration, even when the angle changing member changes the angle of the sheet stacking face of the sheet stacking member, a preferable sheet stacking performance (that is, the sheet stackability) is obtained.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure, and are included in the scope of the invention recited in the claims and its equivalent.

Any one of the above-described operations may be performed in various other ways, for example, in an order different from the one described above.

What is claimed is:

1. A sheet stacker comprising:

a sheet stacking member having an upstream portion in a sheet conveyance direction, the upstream portion being movable in a vertical direction;

a biasing force applier configured to bias the sheet stacking member upward;

an angle changer configured to change an angle of a sheet stacking face of the sheet stacking member, relative to a surface of a sheet conveyed through a sheet conveying portion; and a biasing force change reducer configured to restrain a change of a biasing force acting on the sheet stacking member, before and after a change of the angle of the sheet stacking face of the sheet stacking member by the angle changer.

2. The sheet stacker according to claim 1, further comprising a securing member configured to be attached to an image forming apparatus and support the sheet stacking member, wherein the biasing force applier includes a biasing member disposed between the sheet stacking member and the securing member, wherein the biasing force change reducer includes coupling portion is configured to couple the securing member with the biasing member, and wherein the biasing force change reducer is configured to change a position of the coupling portion with respect to the biasing member on at least one of the sheet stacking member and the securing member, before and after the change of the angle of the sheet stacking member by the angle changer, to restrain the change of the biasing force acting on the sheet stacking member.

3. The sheet stacker according to claim 2, wherein the angle changer includes an angle changing member movable relative to the sheet stacking member, wherein the angle changer is configured to move the angle changing member to a first position to maintain the angle to a first angle and move the angle changing member to a second position to maintain the angle to a second angle, and wherein a position of the coupling portion of the biasing force change reducer changes along with movement of the angle changing member.

4. The sheet stacker according to claim 1, wherein the biasing force change reducer further includes another biasing force applier different from a biasing force of the biasing force applier and is configured to bias the sheet stacking member in the vertical direction, and wherein said another biasing force applier is configured to apply a biasing force different from the biasing force applier, to bias the sheet stacking member, before and after the change of the angle of the sheet stacking member by the angle changer, to restrain the change of the biasing force acting on the sheet stacking member.

5. The sheet stacker according to claim 4, wherein the angle changer includes an angle changing member movable relative to the sheet stacking member, wherein the angle changer is configured to move the angle changing member to a first position to maintain the angle to a first angle and move the angle changing member to a second position to maintain the angle to a second angle, and wherein the position of said another biasing force applier changes along with movement of the angle changing member.

6. The sheet stacker according to claim 5, wherein said another biasing force applier includes a biasing member having one end coupled to the sheet stacking member and an opposite end coupled to the angle changer.

7. The sheet stacker according to claim 4, wherein the biasing force change reducer is configured to switch between a state in which said another biasing force applier applies the biasing force to the sheet stacking member and a state in which said another biasing force applier does not apply the biasing force to the sheet stacking member, before and after the change of the angle of the sheet stacking member by the angle changer, to restrain the change of the biasing force acting on the sheet stacking member.

8. The sheet stacker according to claim 1, wherein the angle changer includes an angle changing member movable relative to the sheet stacking member, wherein the angle changer is configured to move the angle changing member to a first position to maintain the angle to a first angle while the sheet stacking member is retained by the angle changer and move the angle changing member to a second position to maintain the angle to a second angle while the sheet stacking member is not retained by the angle changer and is retained by a retainer, wherein the sheet stacking member has a contact face on which a plurality of ribs is disposed extending in a given direction and the angle changer has a contact target face on which a plurality of ribs is disposed extending in a direction intersecting the given direction of the plurality of ribs of the contact face, and wherein, when the angle changing member is at the first position, the angle changer is configured to maintain the angle to the first angle in a state in which the plurality of ribs of the contact face is in contact with the plurality of ribs on the contact target face.

9. The sheet stacker according to claim 1, wherein the angle changer includes an angle changing member movable relative to the sheet stacking member, wherein the angle changer is configured to move the angle changing member to a first position to maintain the angle to a first angle while the sheet stacking member is retained by the angle changer and move the angle changing member to a second position to maintain the angle to a second angle while the sheet stacking member is not retained by the angle changer and is retained by a retainer, wherein the sheet stacking member has a contact face on which a plurality of ribs is disposed extending in a given direction and the retainer has a sliding target face on which a plurality of ribs is disposed extending in a direction intersecting the given direction of the plurality of ribs of the contact face, and wherein, when the angle changing member is at the second position, the angle changer is configured to maintain the angle to the second angle in a state in which the plurality of ribs of the contact face is in contact with the plurality of ribs on the sliding target face.

10. The sheet stacker according to claim 1, further comprising an upper height limit position regulator configured to regulate the upstream portion in the sheet conveyance direction of the sheet stacking member, before a change of an angle by the angle changer to be an equal upper height limit portion to the upstream portion in the sheet conveyance direction of the sheet stacking member, after the change of the angle by the angle changer.

11. The sheet stacker according to claim 1, wherein the angle changer is rotatably disposed relative to a securing member configured to be attached to an image forming apparatus and support the sheet stacking member, and wherein the angle changer includes a rotary support configured to support the sheet stacking member rotatably in a vertical direction and configured to change a rotational angle of the rotary support to change the angle of the sheet stacking face of the sheet stacking member.

12. The sheet stacker according to claim 1, wherein, as a position of the sheet stacking member shifts downward, the sheet stacking member moves toward downstream in the sheet conveyance direction.

13. An image forming apparatus comprising:

an image bearer configured to form an image on a sheet; and the sheet stacker according to claim 1, configured to stack the sheet having the image.

* * * * *